US005378595A

United States Patent [19]

Takizawa et al.

[11] Patent Number: 5,378,595

[45] Date of Patent: Jan. 3, 1995

[54] SILVER HALIDE PHOTO-SENSITIVE MATERIAL

[75] Inventors: Hiroo Takizawa; Toshiyuki Makuta, both of Kanagawa, Japan

[73] Assignee: Fuji Photo Film Co., Ltd., Kanagawa, Japan

[21] Appl. No.: 203,394

[22] Filed: Mar. 1, 1994

[30] Foreign Application Priority Data

Mar. 2, 1993 [JP] Japan ..... 5-066077

[51] Int. Cl.[6] ..... G03C 7/38; G03C 7/388

[52] U.S. Cl. ..... 430/546; 430/551; 430/558

[58] Field of Search ..... 430/551, 546, 558

[56] References Cited

U.S. PATENT DOCUMENTS 3,895,951 7/1975 Riester et al. ..... 430/551
4,661,440 4/1987 Tschopp et al. ..... 430/551
4,910,126 3/1990 Sato et al. ..... 430/551

FOREIGN PATENT DOCUMENTS 63-301941 12/1988 Japan .

*Primary Examiner*—Lee C. Wright
*Attorney, Agent, or Firm*—Birch, Stewart, Kolasch & Birch

[57] ABSTRACT

A silver halide photo-sensitive material comprising a support, and at least one silver halide emulsion layer, on said support containing at least one compound having the following general formula (I):

(I)

where $R^1$ is an aliphatic group, an aryl group, an aliphatic oxy group or an aryloxy group; and X is an alkylene or alkenylene group forming a five- or six-membered ring. In this event, $R^1$ will not bond to a carbon atom in the ring of X.

18 Claims, No Drawings

SILVER HALIDE PHOTO-SENSITIVE MATERIAL

BACKGROUND OF THE INVENTION

This invention relates to a silver halide photo-sensitive material. More particularly, the present invention relates to a silver halide color photographic sensitive material in which non-diffusion couplers capable of forming non-diffusion dyes are incorporated into a silver halide emulsion layer. The emulsion layer is processed by a color developer containing aromatic primary amine color developing agents and is subjected to photographic processing with a processing solution having a bleaching capacity, thereby forming color images on color photographs.

There are known, various photographic additives that are slightly soluble in water. Typical photographic additives include oil-soluble couplers, antioxidizing agents (alkyl hydroquinones, alkyl phenols, chromans, coumarones, etc.) used for inhibiting fading, color fog or color mixing, hardening agents, oil-soluble filter dyes, oil-soluble ultraviolet light absorbing agents, oil-soluble fluorescent whitening agents, DIR compounds (DIR hydroquinones, colorless DIR couplers, etc.), developers, dye developing agents, DDR redox compounds and DDR couplers. Such photographic additives are dissolved in an adequate oil forming agent, i.e., a high-boiling organic solvent. Commonly used as the high-boiling organic solvent are phthalic acid ester compounds and phosphoric acid ester compounds. The solution of the dissolved additives is included in a hydrophilic organic colloidal layer such that the additives are dispersed in an aqueous solution of hydrophilic organic colloid such as gelatin in the presence of surfactants. The colloidal layer may be a photo-sensitive emulsion layer, a filtering layer, a backing layer, an antihalation layer, an interlayer or a protective layer.

The phthalic ester compounds and the phosphoric ester compounds that serve as the high-boiling organic solvents have been used widely in the photographic field. This is because these compounds are available at low cost, are superior in affinity to colloid such as gelatin and are favorable for dispersing the couplers. In addition, the compounds have a good effect on stability and the hue of formed color images and are chemically stable in the photo-sensitive materials.

However, these well known high-boiling organic solvents (including the phthalic ester compounds and the phosphoric ester compounds) are still insufficient for the more recent photo-sensitive materials that are required to have high performance especially in view of the effects of inhibiting staining and fading of the color images due to light, heat and moisture.

As mentioned above, various requirements have been imposed on the high-boiling organic solvents used for recent photo-sensitive materials. Typical requirements for the high-boiling organic solvents are as follows. They should be readily available or manufactured at low cost and have superior solubility and dispersion stability in photographic additives. The exertion of no adverse effect on developing and photographic properties is also required. Other requirements are involved in safety considerations and the effects on the environment. In addition, the solvents should be excellent in chemical stability and be good for inhibiting the fading of the color images in the case of silver halide color photo-sensitive materials.

In the color photo-sensitive materials, the dyes formed by reaction of the coupler with the developing agent, especially pyrazoloazole magenta dyes and pyrroloazole cyan dyes, are more easily associated with each other in a film. As the absorption band maximum of the aggregates differs from that of dye monomers, excessively large absorption by the aggregates is inadequate due to considerations of color reproduction.

With this respect, a color photo-sensitive material capable of reproducing favorable or desired colors could be provided at a lower manufacturing cost if it would be possible to adjust the absorption band maxima of the dyes by means of shifting the maxima to a shorter or longer wavelengths using additives or the like contained in the same layer as the dyes rather than altering the structure of the dye.

As for these problems, it has been found that some high-boiling organic solvents that could be used as a dispersing medium for the dye-forming non-diffusion couplers have the effect of shifting the absorption maxima of yellow, magenta and cyan dyes towards shorter or longer wavelengths. It has also been found that other high-boiling organic solvents of the type described have the effect of restricting or enhancing the association of the dyes and serve to shift the absorption band. Concern about the presence of such solvents has increased.

For example, JP-A-63-301941 (the term "JP-A" as used herein means an "unexamined" published Japanese patent application) discloses phosphine oxide, phosphinate and phosphonate having the above mentioned effects. However, it is usually difficult with these compounds to provide a sufficient level of the dye hue along with the improved dispersion stability and solubility of the materials required when they are used as the dispersing media. As a result, the color forming properties of the dye-forming non-diffusion couplers tends to decline. In addition, the above mentioned compounds tend to enhance the fading of the dye obtained from the coupler because of, for example, heat, moisture and light when they are incorporated into the same layer as the dye-forming non-diffusion couplers.

SUMMARY OF THE INVENTION

Accordingly, an object of the present invention is to provide a silver halide photo-sensitive material in which various photographic additives have been solved well and dispersed stably.

Another object of the present invention is to provide a silver halide color photographic light sensitive material in which dye-forming non-diffusion couplers exhibit high color forming properties and dyes have superior color reproduction without causing fading of the formed images as well as in which various photographic additives have been solved well and dispersed stably.

The above mentioned objects can be achieved with a silver halide photo-sensitive material comprising a support having thereon photographic structural layers comprising at least one silver halide emulsion layer, wherein at least one of said photographic structural layers contains at least one compound represented by the following general formula (I):

(I)

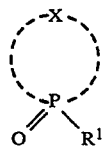

where $R^1$ is an aliphatic group, an aryl group, an aliphatic oxy group or an aryloxy group; and X is an alkylene or alkenylene group forming a five- or six-membered ring, provided that $R^1$ does not bond to a carbon atom in the ring of X.

As for the compounds of formula (I), compounds represented by any one of the following general formulae (IV) through (VII) are preferably:

(IV)

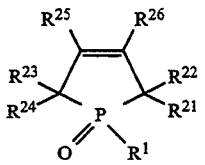

(V)

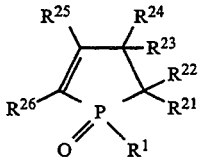

(VI)

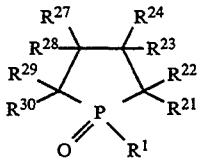

(VII)

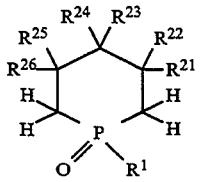

In the general formulae (IV) through (VII), each of $R^{21}$ through $R^{30}$ is a hydrogen atom, an aliphatic group, an aryl group, an aliphatic oxy group, an aryloxy group, an aliphatic or aryl acyloxy group, an alkoxycarbonyl group, an aryloxycarbonyl group, an aliphatic or aryl sulfonyloxy group, a halogen atom, a cyano group, or a nitro group.

The above mentioned compounds contained in the photo-sensitive material in which the dye-forming non-diffusion couplers exhibit high color forming properties and dyes have superior color reproduction without causing fading of the formed images as well as in which various photographic additives have been solved well and dispersed stably.

DETAILED DESCRIPTION OF THE INVENTION

The objects of the present invention have been achieved with a silver halide photo-sensitive material (hereinafter, referred to as the photo-sensitive material) comprising, in at least one layer on supports, at least one of the compounds represented by the following formula (I):

(I)

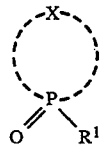

where $R^1$ is an aliphatic group, an aryl group, an aliphatic oxy group or an aryloxy group; and X is an alkylene or alkenylene group forming a five- or six-membered ring, provided that $R^1$ does not bond to a carbon atom in the ring of X.

The present inventor has found that the compound represented by the general formula (I) is adapted to avoid association of the yellow, magenta and cyan dyes, which are obtained by processing yellow, magenta and cyan couplers, respectively, with a color developer containing aromatic primary amine color developing agents and with a processing solution having a bleaching capacity, and to affect the absorption maxima or the spectral absorption of the dyes, improving the color reproduction, the fastness and the hue. The present invention was thus completed. In addition, the inventor also found that the compound represented by the qeneral formula (I) can provide excellent solubility and dispersion stability of the photographic additives when used as the dispersing medium.

The compound represented by the general formula (I) is described in detail.

When substituents disclosed in the present specification comprise an aliphatic moiety, the aliphatic moiety may be in a straight chain, a branched chain or cyclic (such as cycloalkyl) without a specific notice. In addition, the aliphatic moiety may be saturated or unsaturated (such as alkenyl), and may be substituted or unsubstituted. Preferably, the aliphatic moiety is alkyl.

When substituents disclosed in the present specification comprise an aryl moiety, the aryl moiety may or may not be substituted. The aryl moiety may be monocyclic (such as phenyl) or a fused-ring (such as naphthyl). Preferably, the aryl moiety is phenyl.

When substituents disclosed in the present specification comprise a heterocyclic moiety, the hetero atom may be nitrogen, oxygen or sulfur. The heterocyclic moiety is preferably five- to eight-membered. The carbon and nitrogen atoms contained in the ring may be substituted or unsubstituted and may be monocyclic or a fused-ring.

When the aliphatic, aryl and heterocyclic moieties are substituted, the substituents may be an aliphatic group, an aryl group, an aliphatic oxy group, an aryloxy group, an aliphatic oxy carbonyl group, an aryloxy carbonyl group, an acylamino group, a sulfamide group, a carbamoyl group, a sulfamoyl group, an alkoxysulfonyl group, a heterocyclic group, an acyl group, an acyloxy group, a sulfonyloxy group, a cyano group, a nitro group, and a halogen atom.

The number of carbon atoms in a substituent disclosed herein should be considered to indicate the total number of carbon atoms contained in the substituent.

In the general formula (I), $R^1$ is an aliphatic group (methyl, isopropyl, butyl, t-butyl, cyclohexyl, benzyl, allyl, 2-butoxyethyl, 2-ethylhexyl, octyl, 3,5,5-trimethylhexyl, dodecyl, etc.), an aryl group (phenyl, 2-naphthyl, 3-methylphenyl, 4-methoxyphenyl, 2-chlorophenyl, 4-dodecylphenyl, etc.), an aliphatic oxy group (methoxy, 2-ethylhexyloxy, cyclohexyloxy, benzyloxy, t-butoxy, octyloxy, 3,5,5-trimethylhexyloxy, etc.), and an aryloxy group (phenoxy, 1-naphthoxy, 4-methoxy-3-methylphenoxy, 4-dodecylphenoxy, etc.).

Preferably, $R^1$ has from 6 to 25 carbon atoms. In addition, $R^1$ is preferably an aryl group, an aliphatic oxy group or an aryloxy group, more preferably an aryl group, most preferably an phenyl group.

In the general formula (I), X is an alkylene group or alkenylene required for forming the five- or six-membered ring. The alkylene and alkenylene groups may be substituted and the substituents may be bound to each other to form a saturated or an unsaturated ring.

The substituent may preferably be one disclosed as the substituent for the aliphatic moiety and, more preferably an alkyl group or an alkoxy group.

Preferable structures of the compound having the qeneral formula (I) are given by the following general formulae (IV) through (VII):

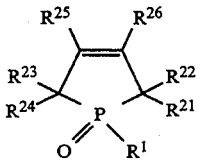
(IV)

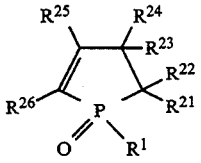
(V)

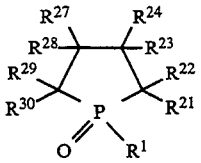
(VI)

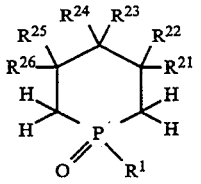
(VII)

In the general formulae (IV) through (VII), each of $R^{21}$ through $R^{30}$ is, preferably, a hydrogen atom, an aliphatic group (preferably having from 1 to 30 carbon atoms; e.g. methyl, ethyl, isopropyl, t-butyl, cyclohexyl, allyl, benzyl, 2-ethylhexyl, octyl, etc.), an aryl group (preferably having from 6 to 30 carbon atoms; e.g. phenyl, 2-naphthyl, etc.), an aliphatic oxy group (preferably having from 1 to 30 carbon atoms; e.g. methoxy, 2-ethylhexyloxy, t-butoxy, etc.), and an aryloxy group (preferably having from 6 to 30 carbon atoms; e.g. phenoxy, 4-nonylphenoxy, 1-naphthoxy, etc.), an aliphatic or aryl acyloxy group (preferably having from 2 to 30 carbon atoms; e.g. acetoxy, benzoyloxy, etc.), an alkoxycarbonyl group (preferably having from 2 to 30 carbon atoms; e.g. methoxycarbonyl, 2-ethylhexyloxycarbonyl, etc.), an aryloxycarbonyl group (preferably having from 7 to 30 carbon atoms; e.g. phenoxycarbonyl, etc.), an aliphatic or aryl sulfonyloxy group (preferably having from 1 to 30 carbon atoms; e.g. methylsulfonyloxy, phenylsulfonyloxy, etc.), a halogen atom (fluorine, chlorine, bromine, etc.), a cyano group, or a nitro group. More preferably, each of $R^{21}$ through $R^{30}$ is a hydrogen atom, an aliphatic group, an aryl group, an aliphatic oxy group, an aryloxy group or an aliphatic or aryl acyloxy group.

Particularly preferably, each of $R^{21}$ through $R^{30}$ is a hydrogen atom, an alkyl group or an alkoxy group.

$R^{21}$ through $R^{30}$ may be bound to each other to form a saturated or an unsaturated ring. $R^1$ does not bind with $R^{21}$ through $R^{30}$ to form a ring. Preferably, $R^{21}$ through $R^{30}$ is not bound to each other to form the ring.

Of the compounds having the general formulae (IV) through (VII), the ones having the general formulae (IV) through (VI) are more preferable.

Specific examples of the compound having the general formula (I) used in the present invention are given below. It is noted that the present invention is not limited to those specific examples.

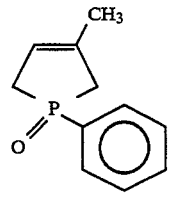
S-1

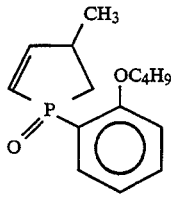
S-2

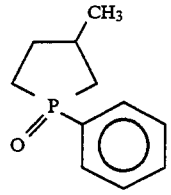
S-3

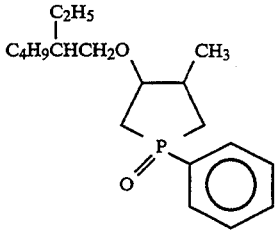
S-4

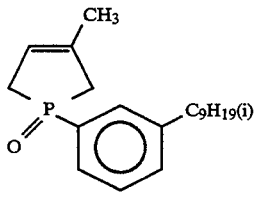
S-5

-continued
S-6
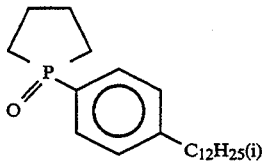
S-7
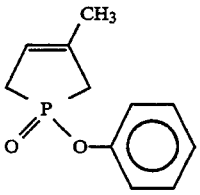
S-8
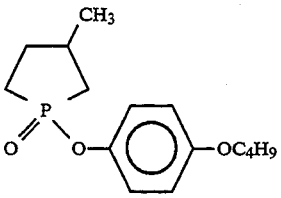
S-9
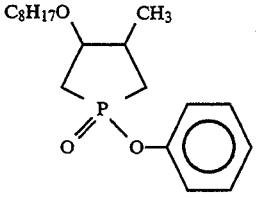
S-10
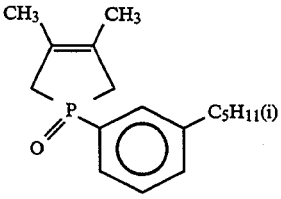
S-11
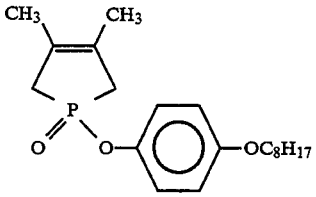
S-12
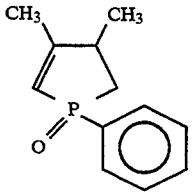
S-13
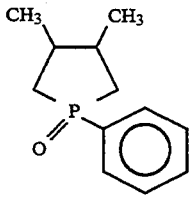
-continued
S-14
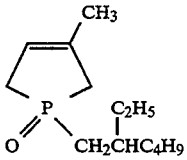
S-15
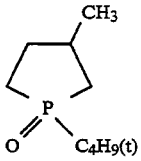
S-16
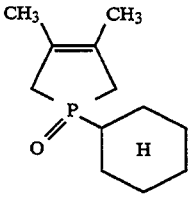
S-17
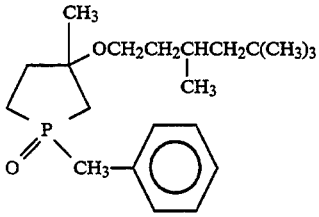
S-18
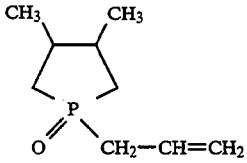
S-19
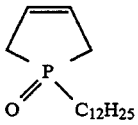
S-20
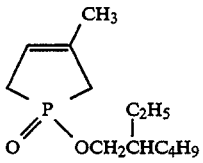
S-21
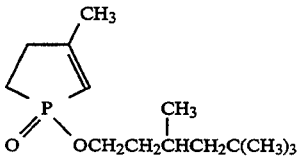
S-22
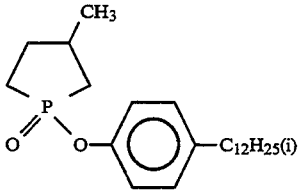

-continued
S-23
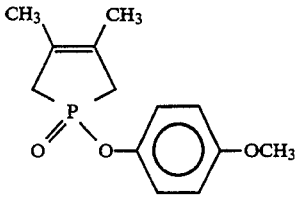
S-24
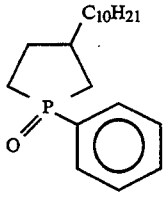
S-25
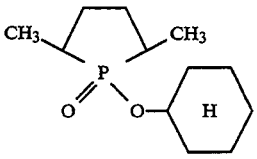
S-26
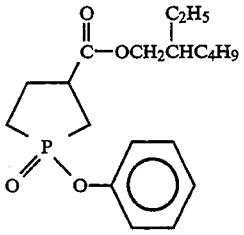
S-27
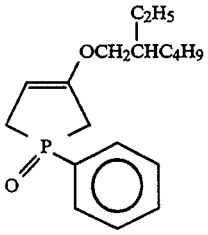
S-28
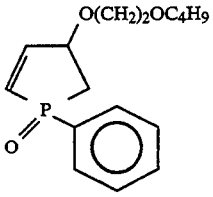
S-29
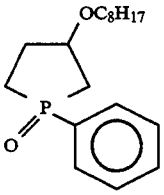
-continued
S-30
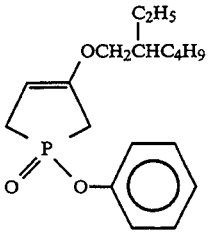
S-31
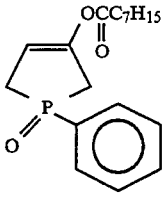
S-32
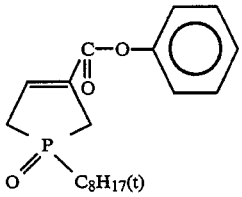
S-33
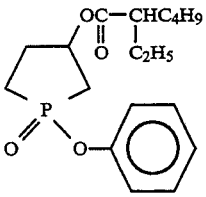
S-34
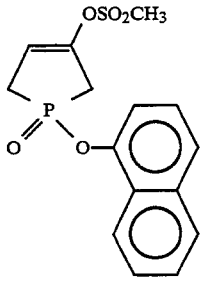
S-35
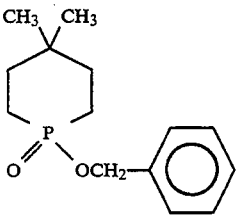
S-36
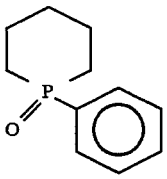

-continued

S-37

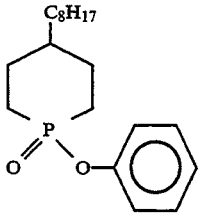

S-38

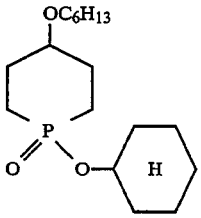

S-39

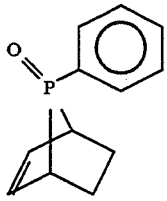

S-40

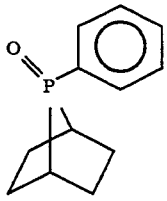

S-41

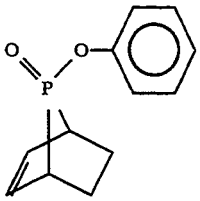

S-42

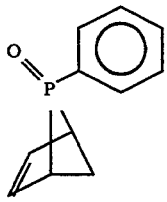

S-43

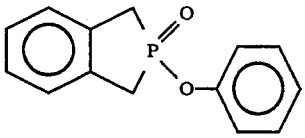

S-44

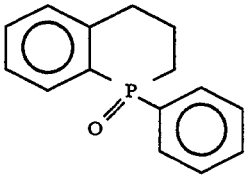

-continued

S-45

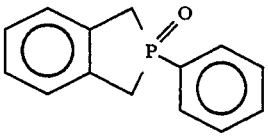

S-46

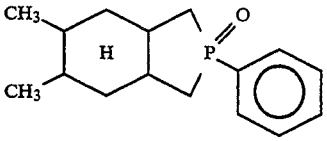

The compound having the general formula (I) applicable to the present invention may be obtained through an example of synthesis which is set forth below.

SYNTHESIS OF S-1

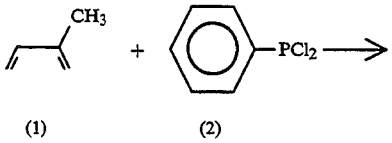

(1) (2)

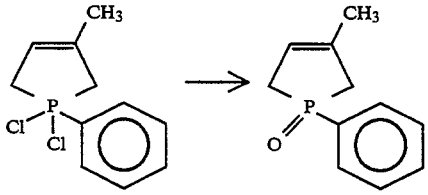

(3) S-1

89.5 g (0.5 mol) of dichlorophenylphosphine (2) was dissolved in 150 ml (about 1.5 mol) of isoprene (1), to which 1.0 g of 2,6-di-t-butyl-4-methylphenol was added as a polymerization inhibitor. The mixture was hermetically contained in a vessel and let stand for seven days at room temperature. The supernatant solution was subjected to decantation. The remaining oil (3) was washed with hexane and 100 ml of water was added to the oil (3) while being cooled with ice and water. A 20%-sodium hydroxide solution was then slowly dripped and stirred into the oil until pH 5 was reached. The temperature was held at 25° C. or less. Ethyl acetate was added to the mixed solution to extract an organic layer. The extracted organic layer was washed with water, dried by magnesium sulfate and then concentrated. The concentrated product was purified by the silica gel column chromatography (eluent: ethyl acetate/hexane=1/1→ethyl acetate/methanol=4/1). A white solid product, the compound S-1, was obtained. Yield: 54.6 g (56.8%). Melting point: 60° C.

The molecular structure was confirmed by an NMR spectrum and an MS spectrum.

The compound represented by the general formula (I) according to this invention is contained in at least one layer on the supports. Preferably such layer is a hydrophilic colloidal layer. The compound is thus advantageously contained in a silver halide emulsion layer containing at least one dye-forming non-diffusion coupler.

There is no possibility of coupling of the compound having the general formula (I) used in this invention with an oxidation product of the developing agent, which otherwise results in the formation of dyes. In other words, the compound of this invention is a non-coloring compound. Accordingly, the molecular structure thereof has no coupler residue. The compound having the general formula (I) used in this invention mainly serves as a high-boiling organic solvent. The term "high-boiling" used herein means a boiling point of 175° C. or higher under atmospheric pressure.

The amount of the compound having the general formula (I) used may be varied depending on applications and is not particularly limited. The amount of the compound used is preferably within the range from 0.0002 to 20 g, and more preferably, from 0.001 to 5 g per 1 $m^2$ of the photo-sensitive material. The amount is typically within the range from 0.1 to 4.0, by weight ratio, with respect to the photographic additives such as the couplers. Preferably, it is within the range from 0.1 to 2.0.

Dispersions consist of the compound having the general formula (I) and the photographic additives such as the couplers. The amount of the dispersions used with respect to the dispersing medium is between 2.0 and 0.1, and preferably, between 1.0 and 0.2 per 1.0 dispersion. A typical dispersing medium is gelatin. A hydrophilic polymer such as polyvinyl alcohol may also be advantageously used as the dispersing medium. The dispersions in this invention may contain various compounds depending on the applications along with the above mentioned compound and the photographic additives.

The compound having the general formula (I) according to this invention can be used together with one or more known high-boiling organic solvents. With the known high-boiling organic solvent(s), the compound used in this invention is preferably not lower than 10%, by weight, and more preferably, not lower than 30% of the total amount of the high-boiling organic solvents.

An example of a high-boiling solvent used with the compound in the present invention is disclosed in U.S. Pat. No. 2,322,027. Specific examples of the high-boiling rganic solvent having a boiling point of 175° C. or higher under atmospheric pressure include: phthalic esters (dibutyl phthalate, dicyclohexyl phthalate, di-2-ethylhexyl phthalate, didecyl phthalate, bis(2,4-di-t-amylphenyl)phthalate, bis(2,4-di-t-amylphenyl)isophthalate, bis(1,1-diethylpropyl)phthalate, etc.), esters of phosphoric acid or phosphonic acid (triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate, etc.), benzoic esters (2-ethylhexyl benzoate, dodecyl benzoate, 2-ethylhexyl-p-hydroxy benzoate, etc.), amides (N,N-diethyldodecaneamido, N,N-diethyllaurylamido, N-tetradecylpyrrolidone, etc.), sulfamides (N-butylbenzenesulfonamido, etc.), alcohols or phenols (isostearyl alcohol, 2,4-di-t-amylphenol, etc.), aliphatic carboxylates (bis(2-ethylhexyl)sebacate, dioctyl azelate, glycerol tributylate, isostearyl lactate, trioctyl citrate, etc.), aniline derivatives (N,N-dibutyl-2-butoxy-5-t-octylaniline, etc.), hydrocarbons (paraffin, dodecyl benzene, diisopropyl naphthalene, etc.), and chlorinated paraffins. As a co-solvent, organic solvents can be used that have a boiling point of 30° C. or higher, preferably, not lower than 50° C. and not higher than about 160° C. Typical examples include: ethyl acetate, butyl acetate, ethyl propionate, methyl ethyl ketone, cyclohexanone, 2-ethoxyethyl acetate, and dimethylformamido.

The photographic additives applicable to the present invention include, besides the dye-forming non-diffusion couplers (yellow, cyan and magenta couplers), antioxidizing agents (alkyl hydroquinones, alkyl phenols, chromans, coumarones, etc.) used for inhibiting fading, color fog or color mixing, hardening agents, oil-soluble filter dyes, oil-soluble ultraviolet light absorbing agents, oil-soluble fluorescent whitening agents, DIR compounds (DIR hydroquinones, colorless DIR couplers, etc.), developers, dye developing agents, DDR redox compounds and DDR couplers.

Specific examples of the yellow coupler are disclosed in, for example, U.S. Pat. Nos. 3,933,501, 4,022,620, 4,326,024, 4,401,752 and 4,248,961, JP-B-58-10739 (the term "JP-B" as used herein means an "examined" Japanese patent publication), U.K. Patent Nos. 1,425,020 and 1,476,760, U.S. Pat. Nos. 3,973,968, 4,314,023, and 4,511,649, European Patent Nos. 249473A, 446863A, and 447969, JP-A-63-23145, JP-A-63-123047, JP-A-1-250944, JP-A-1-213648, JP-A-2-139544, JP-A-3-179042, and JP-A-3-203545.

The magenta coupler may be a compound of 5-pyrazolone or pyrazoloazole family. Such a compound is disclosed in, for example, U.S. Pat. Nos. 4,310,619 and 4,351,897; European Patent No. 73636; U.S. Pat. Nos. 3,061,432 and 3,725,067; *Research Disclosure*, No. 24220 (June, 1984); JP-A-60-33552; *Research Disclosure*, No. 24230 (June, 1984); JP-A-60-43659, JP-A-61-72238, JP-A-60-35730, JP-A-55-118034, and JP-A-60-185951; U.S. Pat. Nos. 4,500,630, 4,540,654, and 4,556,630; and International Publication No. WO88/04795.

The cyan coupler may be a phenol or naphthol coupler. Preferable cyan couplers are disclosed in, for example, U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173; West German Patent No. 3329729; European Patent Nos. 121365A and 249453A; U.S. Pat. Nos. 3,446,622, 4,333,999, 4,775,616, 4,451,559, 4,427,767, 4,690,889, 4,254,212 and 4,296,299; and JP-A-61-42658. Also applicable are azole couplers disclosed in JP-A-64-553, JP-A-64-554, JP-A-64-555 and JP-A-64-556; and Japanese Patent Application Nos. 3-280964 and 3-335916; imidazole couplers disclosed in U.S. Pat. No. 4,818,672 and JP-A-2-33144; an imidazole coupler disclosed in JP-A-64-32260; and a cyclic active methylene-type cyan coupler disclosed in JP-A-64-32260.

In the present invention, it is preferable to use the compound having the general formula (I) together with a cyan coupler having general formula (II) or a magenta coupler having general formula (III). This is because the compound greatly affects the maximum absorption wavelength of the dye and the magnitude of an association peak when being used with such a coupler.

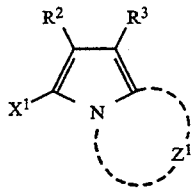

(II)

-continued (III)

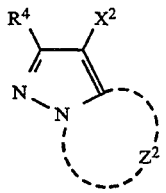

In the formulae, $Z^1$ and $Z^2$ are each a group of non-metalic atoms required for forming an azole ring in which the hetero atom is nitrogen. $R^2$ and $R^3$ are each an electron withdrawing group of which substituent constant $\sigma_p$ in the Hammett equation is not smaller than 0.30. $R^4$ is a hydrogen atom or a substituent. $X^1$ and $X^2$ are each hydrogen atom or a group eliminated from the coupler when being subjected to coupling with an oxidation product of an aromatic primary amine color developing agent.

The azole rings formed of $Z^1$ or $Z^2$ are as set forth below.

(Z-1)

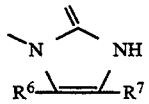

(Z-2)

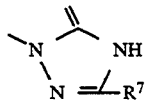

(Z-3)

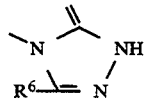

(Z-4)

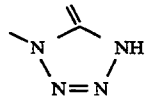

(Z-5)

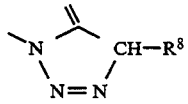

(Z-6)

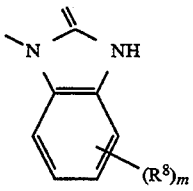

(Z-7)

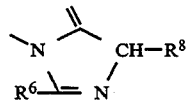

(Z-8)

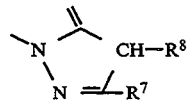

In the formulae, $R^6$, $R^7$ and $R^8$ are each a hydrogen atom or a substituent. As $Z^1$ and $Z^2$, the above Z-2 and Z-3 are preferable, and Z-2 is more preferable.

$R^2$ and $R^3$ are each an electron withdrawing group of which substituent constant $\sigma_p$ in the Hammett equation is not smaller than 0.30 but not larger than 1.0. Hammett's rule is an experimental rule advocated by L. P. Hammett in 1935 to study quantitatively the effect of substituents on reaction or equilibrium of benzene derivatives. This rule has been considered to be adequate in recent years. The substituent constant in the Hammett equation may be either $\sigma_p$ or $\sigma_m$ value. The specific values thereof are disclosed in many general articles. For example, details are shown in *Lange's Handbook of Chemistry*, twelfth edition, edited by J. A. Dean, McGraw-Hill (1979) and *Kagaku-no Ryoiki Zokan*, Vol. 122, pages 96–103, Nanko-do (1979). In this invention, $R^2$ and $R^3$ are defined by Hammett's substituent constant $\sigma_p$. However, the present invention is not limited to the substituents of which substituent constants are known and disclosed in articles. Instead, it is understood that the present invention covers any substituent of which the substituent constant has not appeared in an article but is within the range specified above when being measured ccording to the Hammett's rule.

$R^2$ and $R^3$ are described in detail. Examples of the electron withdrawing group having the $\sigma_p$ value of not smaller then 0.30 include: an acyl group (acetyl, 3-phenylpropanoyl, benzoyl, 4-dodecyloxybenzoyl, etc.), a carbamoyl group (carbamoyl, N-ethylcarbamoyl, N-phenylcarbamoyl, N,N-dibutylcarbamoyl, N-(2-dodecyloxyethyl)carbamoyl, N-(4-n-pentadecaneamido)phenylcarbamoyl, N-methyl-N-dodecylcarbamoyl, N-{3-(2,4-di-t-amylphenoxy)-propyl}carbamoyl, etc.), an aliphatic oxycarbonyl group (preferably an alkoxycarbonyl group (methoxycarbonyl, ethoxycarbonyl, isopropyloxycarbonyl, t-butyloxycarbonyl, isobutyloxycarbonyl, butyloxycarbonyl, dodecyloxycarbonyl, octadecyloxycarbonyl, 2,6-di-t-butyl-4-methyl-cyclohexyloxycarbonyl, etc.)), an aryloxycarbonyl qroup (phenoxycarbonyl, etc.), a cyano group, a nitro group, a sulfinyl group (3-phenoxypropylsulfinyl, 3-pentadecylphenylsulfinyl, etc.), a sulfonyl group (methanesulfonyl, octanesulfonyl, benzenesulfonyl, toluenesulfonyl, etc.), a sulfonyloxy group (methanesulfonyloxy, toluenesulfonyloxy, etc.), a sulfamoyl group (N-ethylsulfamoyl, N,N-dipropylsulfamoyl, N-(2-dodecyloxyethyl)sulfamoyl, N-ethyl-N-dodecylsulfamoyl, N,N-diethylsulfamoyl, etc.), an alkyl group substituted by at keast three or more fluorine atoms (trifluoromethane, heptafluoropropane, etc.), and a perfluoroaryl group (pentafluorophenyl, etc.).

Typical electron withdrawing groups having the $\sigma_p$ values of not smaller than 0.30 and those $\sigma_p$ values are as follows: the cyano group (0.66), the nitro group (0.78), the trifluoromethyl group (0.54), the carboxyl group (0.45), the acetyl group (0.50), the benzoyl group (0.43), the trifluoromethanesulfonyl group (0.92), the methanesulfonyl group (0.72), the benzenesulfonyl group (0.70), the methanesulfinyl group (0.49), the carbamoyl group (0.36), the methoxycarbonyl group (0.45), the ethoxycarbonyl group (0.45), the phenoxycarbonyl group (0.44), the pyrazolyl group (0.37), the methanesulfonyloxy group (0.36), the dimethoxyphosphoryl group (0.60), the sulfamoyl group (0.57) and the pentafluorophenyl group (0.41).

In the general formula (II), $R^2$ and $R^3$ are each preferably a cyano group, an acyl group, a carbamoyl group or an aliphatic oxycarbonyl group or an aryloxycarbonyl group. More preferably, $R^2$ is a cyano group and $R^3$ is a group represented by $—CO_2—R^9$ ($R^9$ is an aliphatic group (preferably an alkyl group or an aryl group)). $R^9$ of a cyclic or branched alkyl group is particularly preferable.

$R^4$, $R^6$, $R^7$ and $R^8$ are each a hydrogen atom or a substituent. The substituent may be an aryl group (preferably having from 6 to 30 carbon atoms; e.g. phenyl, m-acetylaminophenyl, o-methoxyphenyl, p-methoxyphenyl, p-tetradecoxycarbonylpropyonylaminophenyl, etc.), an alkyl group (preferably having from 1 to 30 carbon atoms; e.g. methyl, trifluoromethyl, ethyl, isopropyl, heptafluoropropyl, t-butyl, n-octyl, n-dodecyl, etc.), a cyano group, a formyl group, an acyl group (preferably having from 1 to 30 carbon atoms; e.g. acetyl, pivaloyl, benzoyl, furoyl, 2-pyridinecarbonyl, etc.), a carbamoyl group (preferably having from 1 to 30 carbon atoms; e.g. methylcarbamoyl, ethylcarbamoyl, dimethylcarbamoyl, n-octylcarbamoyl, etc.), an alkoxycarbonyl group (preferably having from 1 to 30 carbon atoms; e.g. methoxycarbonyl, ethoxycarbonyl, isopropoxycarbonyl, diphenylmethylcarbonyl, etc.), an aryloxycarbonyl group (preferably having from 7 to 30 carbon atoms; e.g. phenoxycarbonyl, p-methoxyphenoxycarbonyl, m-chlorophenoxycarbonyl, o-methoxyphenoxycarbonyl, etc.), a formylamino group, an acylamino group [an alkylcarbonylamino group preferably having from 1 to 30 carbon atoms (such as acetylamino, propyonylamino, cyanoacetylamino, etc.), an arylcarbonylamino group preferably having from 7 to 30 carbon atoms (such as benzoylamino, p-toleylamino, pentafluorobenzoylamino, m-methoxybenzoylamino, etc.), a heterylcarbonylamino group preferably having from 4 to 30 carbon atoms (such as 2-pyridylcarbonylamino, 3-pyridylcarbonylamino, furoylamino, etc.)], an alkoxycarbonylamino group (preferably having from 2 to 30 carbon atoms; e.g. methoxycarbonylamino, ethoxycarbonylamino, methoxyethoxycarbonylamino, etc.), an aryloxycarbonylamino group (preferably having from 7 to 30 carbon atoms; e.g. phenoxycarbonylamino, p-methoxyphenoxycarbonylamino, p-methylphenoxycarbonylamino, m-chlorophenoxycarbonylamino, etc.), a sulfamide group (preferably having from 1 to 30 carbon atoms; e.g. metasulfonamido, benzenesulfonamido, p-toluenesulfonamido, etc.), ureides (preferably having from 1 to 30 carbon atoms; e.g. methylureido, dimethylureido, p-cyanophenylureido, etc.), a sulfamoylamino group (preferably having from 1 to 30 carbon atoms; e.g. methylaminosulfonylamino, ethylaminosulfonylamino, anilinosulfonylamino, etc.), an unsubstituted amino group, an alkylamino group (preferably having from 1 to 30 carbon atoms; e.g. methylamino, dimethylamino, ethylamino, diethylamino, n-butylamino, etc.), an arylamino group (preferably having from 6 to 30 carbon atoms; e.g. anilino, etc.), an alkoxy group (preferably having from 1 to 30 carbon atoms; e.g. methoxy, ethoxy, isopropoxy, n-butoxy, methoxyethoxy, n-dodecyloxy, etc.), an aryloxy group (preferably having from 6 to 30 carbon atoms; e.g. phenoxy, m-chlorophenoxy, p-methoxyphenoxy, o-methoxyphenoxy, etc.), a heteryloxy group (preferably having from 3 to 30 carbon atoms; e.g. tetrahydropyranyloxy, 3-pyrosyloxy, 2-(1,3-benzimidazolyl)oxy, etc.), an alkylthio group (preferably having from 1 to 30 carbon atoms; e.g. methylthio, ethylthio, n-butylthio, t-butylthio, etc.), an arylthio group (preferably having from 6 to 30 carbon atoms; e.g. phenylthio, etc.), a heterylthio group (preferably having from 3 to 30 carbon atoms; e.g. 2-pyridylthio, 2-(1,3-benzimidazolyl)thio, 1-hexadecyl-1,2,3,4-tetrazolyl-5-thio, 1-(3-N-octadecylcarbamoyl)phenyl-1,2,3,4-tetrazolyl-5-thio, etc.), a heterocyclic group (preferably having from 3 to 30 carbon atoms; e.g. 2-benzoxazolyl, 2-benzothiazolyl, 1-phenyl-2-benzimidazolyl, 5-chloro-1-tetrazolyl, 1-pyrrolyl, 2-furany1, 2-pyridyl, 3-pyridyl, etc.), halogen atoms (fluorine, chlorine, bromine, etc.), a hydroxy group, a nitro group, a sulfamoyl group (preferably having from 0 to 30 carbon atoms; e.g. methylsulfamoyl, dimethylsulfamoyl, ethylsulfamoyl, N,N-dipropylsulfamoyl, etc.), a sulfonyl qroup (preferably having from 1 to 30 carbon atoms; e.g. methanesulfonyl, benzenesulfonyl, toluenesulfonyl, trifluoromethanesulfonyl, difluoromethanesulfonyl, etc.), an alkyloxy group (preferably having from 1 to 30 carbon atoms; e.g. formyloxy, acetyloxy, benzoyloxy, etc.), a carbamoyloxy group (preferably having from 1 to 30 carbon atoms; e.g. methylcarbamoyloxy, diethylcarbamoyloxy, etc.), imides (preferably having from 4 to 30 carbon atoms; e.g. succinimido, phthalimido, etc.), a sulfinyl group (preferably having from 1 to 30 carbon atoms; e.g. diethylaminosulfinyl, etc.), a phosphoryl group (preferably having from 0 to 30 carbon atoms; e.g. dimethoxyphosphoryl, diphenylphosphoryl, etc. ), a carboxyl group, a phosphono group, and an unsubstituted amino group. They may have a similar substituent, when possible. $R^4$, $R^6$ and $R^7$ are each preferably an alkyl or aryl group.

A branched alkyl group is especially preferable for $R^4$. As $R^6$ and $R^7$, an aryl group is more preferable and an aryl group substituted by alkoxy, acylamino, sulfonamido or alkyl group is yet further preferable.

$X^1$ and $X^2$ are each a hydrogen atom or a group (hereinafter, referred to as "eliminated group") adapted to be eliminated from the coupler during coupling with an oxidation product of the aromatic primary amine color developing agent. Examples of the eliminated group include: halogen atoms (fluorine, chlorine, bromine, etc.), an alkoxy group (ethoxy, dodecyloxy, methoxyethylcarbamoylmethoxy, carboxypropyloxy, methylsulfonylethoxy, etc.), an aryloxy group (4-chlorophenoxy, 4-methoxyphenoxy, 4-carboxyphenoxy, etc.), an acyloxy group (acetoxy, tetradecanoyloxy, benzoyloxy, etc.), a sulfonyloxy group (methanesulfonyloxy, toluenesulfonyloxy, etc.), an acylamimo group (dichloroacetylamino, heptafluorobutylylamino, etc.), a sulfamide group (methanesulfonamido, p-toluenesulfonamido, etc.), an alkoxycarbonyloxy group (ethoxycarbonyloxy, benzylcarbonyloxy, etc.), an aryloxycarbonyloxy group (phenoxycarbonyloxy, etc.), an alkylthio group (carboxymethylthio, etc.), an arylthio group (2-butoxy-5-t-octylphenylthio, etc.), a heterocyclic thio group (tetrazolylthio, etc.), a carbamoylamino group (N-methylcarbamoylamino, N-phenylcarbamoylamino, etc.), a five- or six-membered nitrogen-containing heterocyclic group (imidazolyl, pyrazolyl, triazolyl, tetrazolyl, 1,2-dihydro- 2-oxo-1-pyridyl, etc.), imides (succinimido, hydantoinyl, etc.), an aromatic azo group (phenylazo, etc.), a sulfinyl group (2-butoxy-5-t-octylphenylsulfinyl, etc.), and a sulfonyl group (2-butoxy-5-t-octylphenylsulfonyl, etc.).

A halogen atom and an arylthio group are preferable for $X^1$ and $X^2$, a chlorine atom is further preferable for $X^1$ and $X^2$.

In the coupler with the general formula (II) or (III), the group $R^2$, $R^3$, $R^4$, $R^6$, $R^7$ or $R^8$ may contain a coupler residue represented in the general formula (II) or (III) to form a dimer, trimer or polymer. Alternatively, the group $R^2$, $R^3$, $R^4$, $R^6$, $R^7$ or $R^8$ may contain a polymer chain so that the coupler is in the form of a homopolymer or a copolymer. A typical example of the coupler in the form oi the homopolymer or the copolymer is an addition polymerization type homopolymer or copolymer of unsaturated ethylenic compounds which has the coupler residue found in general formula (II) or (III). In this event, the polymer may contain one or more kinds of color generating repeated units having the coupler residue found in the general formula (II) or (III). Alternatively, the polymer may be a copolymer in which one or more types of non-coloring ethylenic monomers as copolymer units have entered the chain. Examples of the ethylenic monomer are: acrylic esters, methacrylic esters and maleic ester.

Specific examples of the compound represented by the general formula (II) or (III) are set forth below. However, the present invention is not limited to these examples.

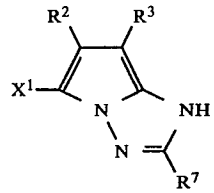
| No. | $R^2$ | $R^3$ | $R^7$ | $X^1$ |
|---|---|---|---|---|
| C-1 | $-CO_2CH_3$ | CN | 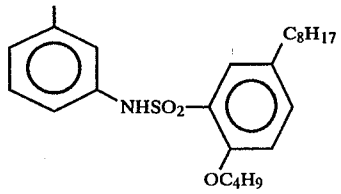 | H |
| C-2 | CN | 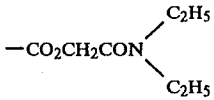 | 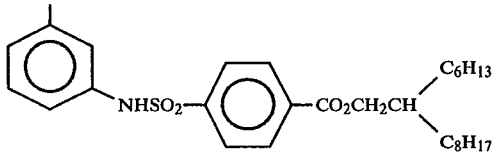 | 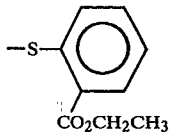 |
| C-3 | CN | 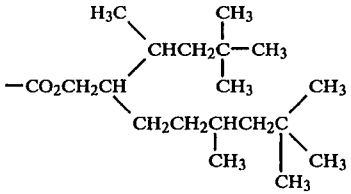 | 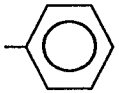 | H |
| C-4 | CN | 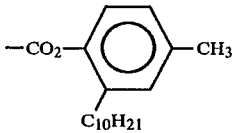 | 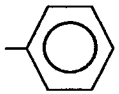 | H |

-continued
| | | | | |
|---|---|---|---|---|
| C-5 | CN | 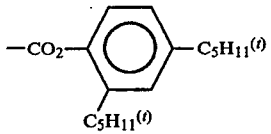 | 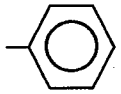 | H |
| C-6 | $CF_3$ | CN | 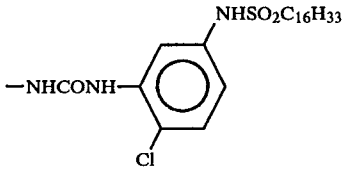 | Cl |
| C-7 | CN | 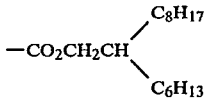 | 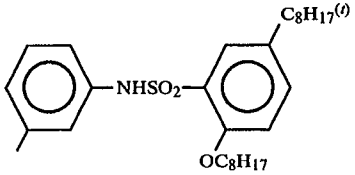 | H |
| C-8 | CN | $-CO_2C_{12}H_{25}$(sec) | 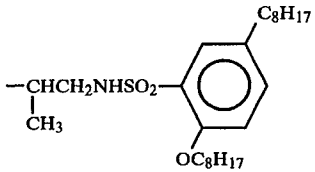 | Cl |
| C-9 | 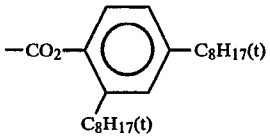 | CN | $-C(CH_3)_3$ | 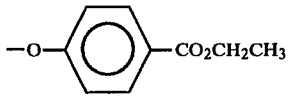 |
| C-10 | CN | $CF_3$ | 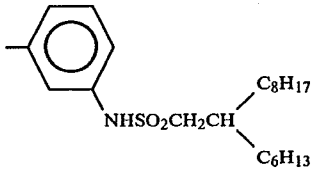 | Cl |

-continued
| | | | | |
|---|---|---|---|---|
| C-11 | CN | 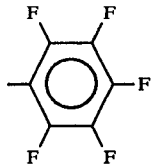 | 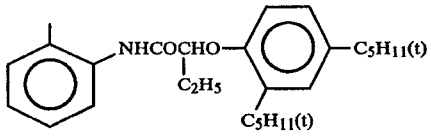 | 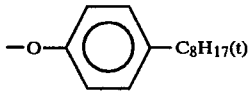 |
| C-12 | CN | 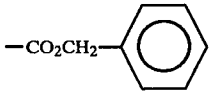 | 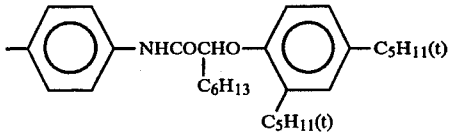 | H |
| C-13 | CN | 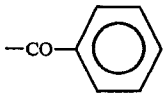 | 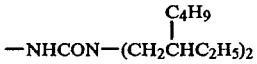 | $-OSO_2CH_3$ |
| C-14 | CN | $-CO_2C_4H_9$ | 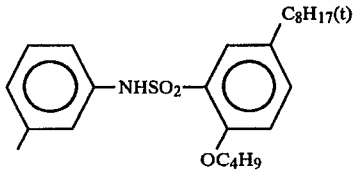 | H |
| C-15 | CN | 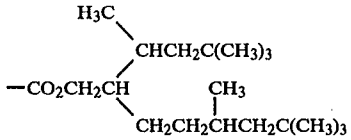 | 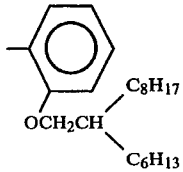 | Cl |
| C-16 | CN | 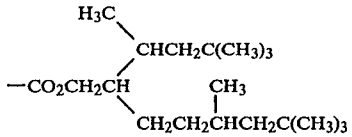 | 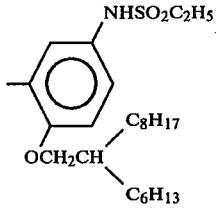 | Cl |

-continued
| | | | | |
|---|---|---|---|---|
| C-17 | CN | $-CO_2CH(CH_3)_2$ | 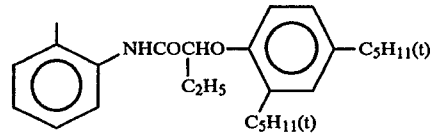 | H |
| C-18 | CN | $-CON(C_2H_5)_2$ | 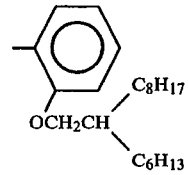 | Cl |
| C-19 | $-CO_2C_2H_5$ | CN | $\leftarrow CH_2-CH(-CH_2CH_2NHC{=}O)\rightarrow_X \leftarrow CH_2-CH(CH_3)(COOC_2H_5)\rightarrow_Y$ X:Y = 50:50 | Cl |
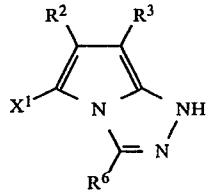
| No. | $R^2$ | $R^3$ | $R^6$ | $X^1$ |
|---|---|---|---|---|
| C-20 | $-CO_2C_2H_5$ | CN | 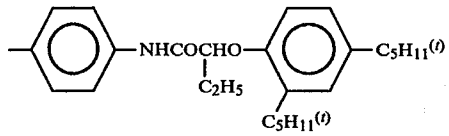 | Cl |
| C-21 | CN | $-CO_2CH_2CH(C_6H_{13})(C_8H_{17})$ | 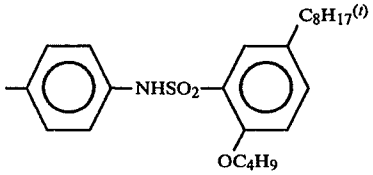 | H |

-continued
| | | | | |
|---|---|---|---|---|
| C-22 | CN | 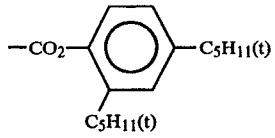 | 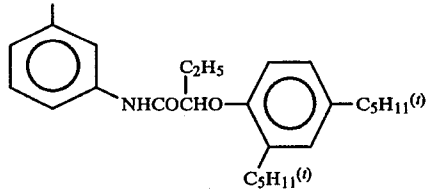 | 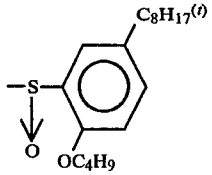 |
| C-23 | $-SO_2CH_3$ | 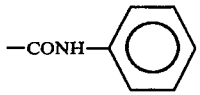 | 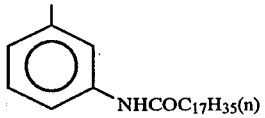 | 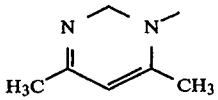 |
| C-24 | $-CO_2C_2H_5$ | $-CO_2C_2H_5$ | 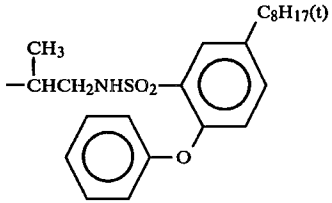 | Cl |
(C-25)
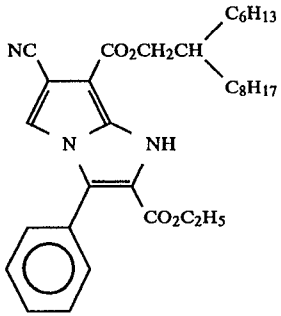
(C-26)
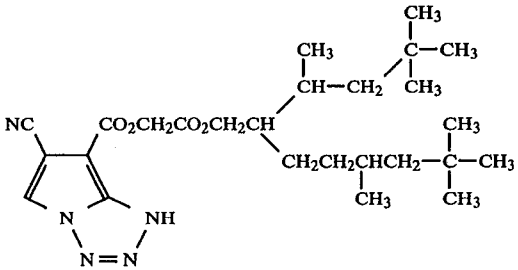

-continued
(C-27)
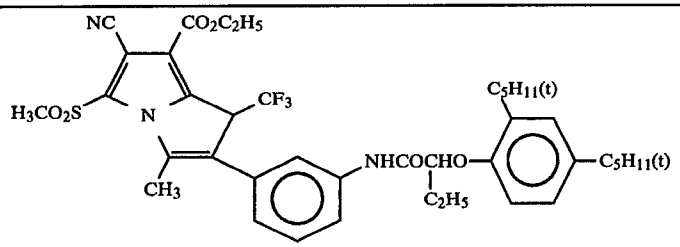
(C-28)
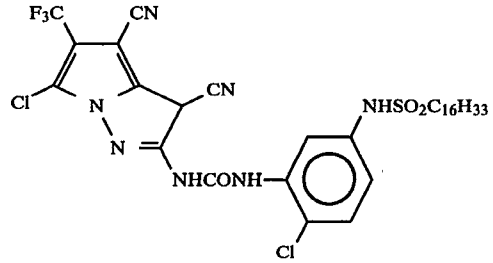
(C-29)
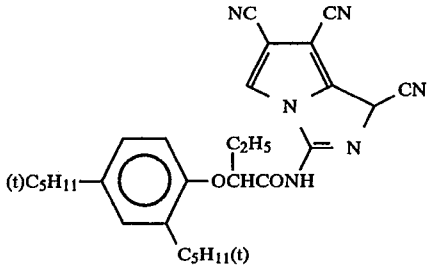
(C-30)
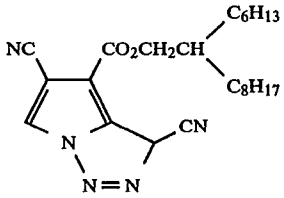
(C-31)
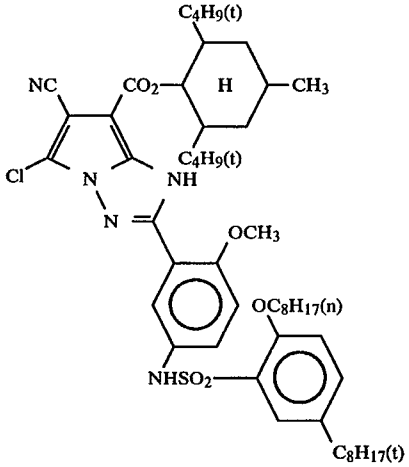

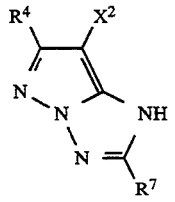
| | $R^4$ | $R^7$ | $X^2$ |
|---|---|---|---|
| M-1 | $CH_3$— | 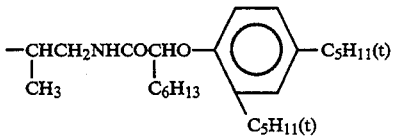 | Cl |
| M-2 | 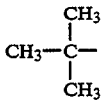 | 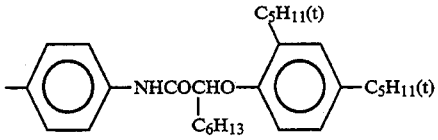 | " |
| M-3 | " | 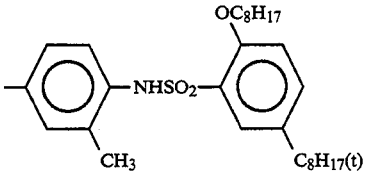 | " |
| M-4 | " | 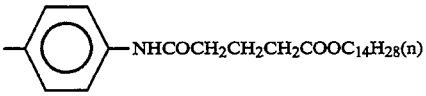 | " |
| M-5 | " | 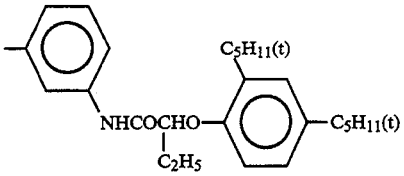 | " |
| M-6 | $CH_3$— | 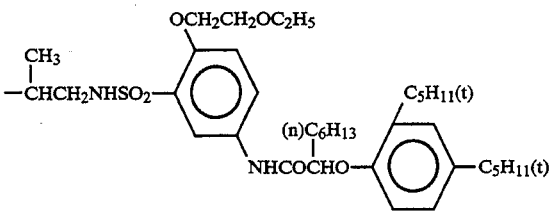 | Cl |
| M-7 | " | 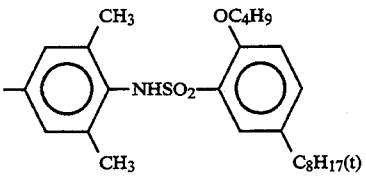 | " |

-continued
| | | | |
|---|---|---|---|
| M-8 | " | 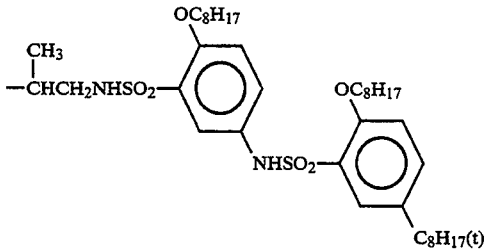 | " |
| M-9 | 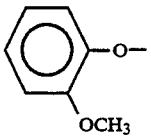 | 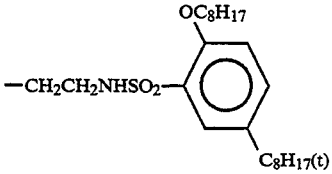 | 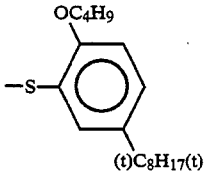 |
| M-10 | $C_2H_5$— | 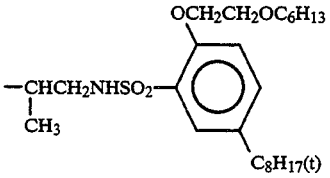 | 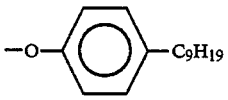 |
| M-11 | 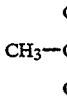 | 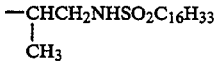 | 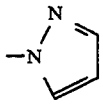 |
| M-12 | 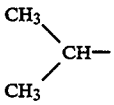 | 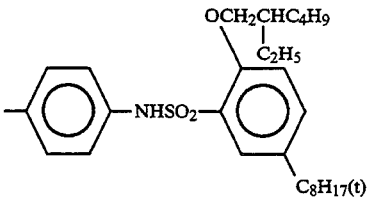 | Cl |
| M-13 | 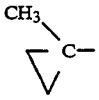 | 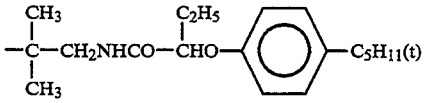 | " |
| M-14 | $C_2H_5O$— | 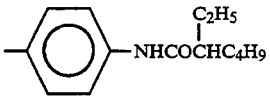 | 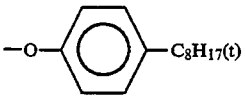 |
| M-15 | $C_2H_5O$— | 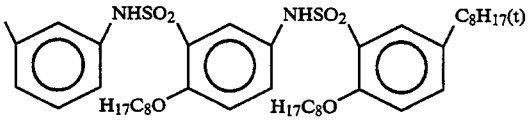 | 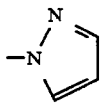 |
| M-16 | 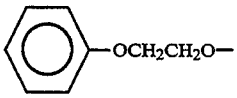 | " | 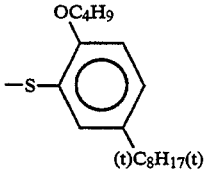 |
| M-17 | $C_2H_5O$— | 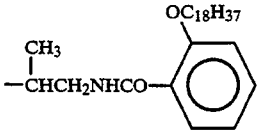 | 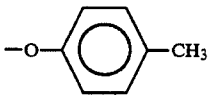 |

-continued
| | | | |
|---|---|---|---|
| M-18 | $CH_3$— | 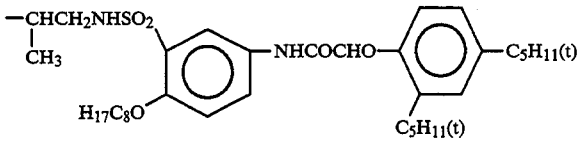 | Cl |
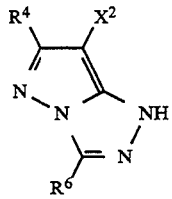
| | $R^4$ | $R^6$ | $X^2$ |
|---|---|---|---|
| m-1 | 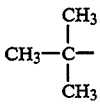 | $\leftarrow CH_2 \rightarrow_3 SO_2C_{12}H_{25}$ | Cl |
| m-2 | " | $-CH(CH_3)CH_2SO_2C_{12}H_{25}$ | " |
| m-3 | " | 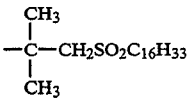 | " |
| m-4 | " | 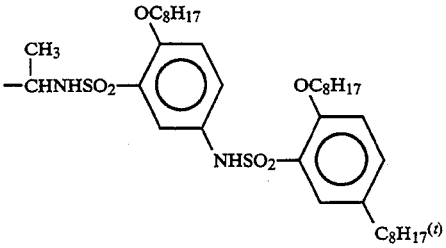 | " |
| m-5 | " | 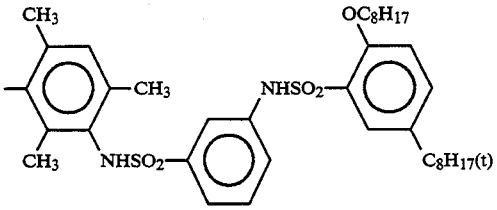 | " |
| m-6 | 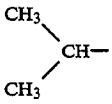 | 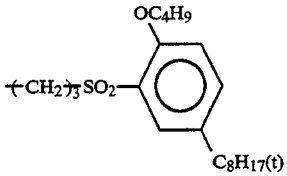 | Cl |
| m-7 | " | 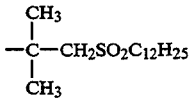 | 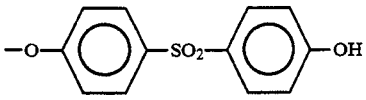 |
| m-8 | $C_2H_5$— | 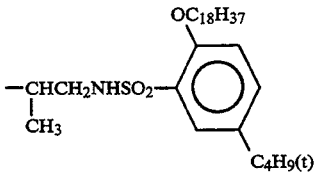 | 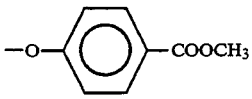 |

-continued

| | | | |
|---|---|---|---|
| m-9 | $CH_3$— | $C_{12}H_{25}(n)$<br>—CHNCOCH$_2$CH$_2$COOH<br>$C_8H_{17}$ | Cl |
| m-10 | " | $C_{12}H_{25}(n)$<br>—CHO— —NHSO$_2$— COOH | Cl |
| m-11 | $CH_3$<br>$CH_3$—C—<br>$CH_3$ | $CH_3$ NHCOCHCH$_2$CH$_2$SO$_2$CH$_3$<br>NHCOC$_{11}$H$_{23}$(n)<br>$CH_3$<br>$CH_3$ | Cl |

m-12

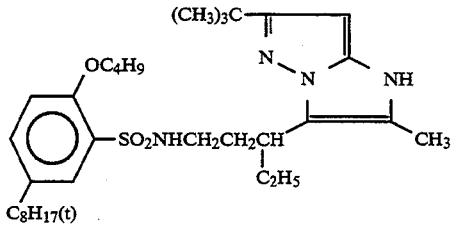

m-13

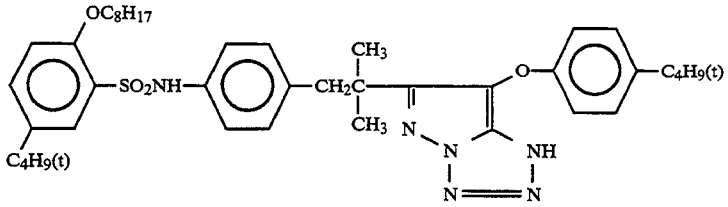

m-14

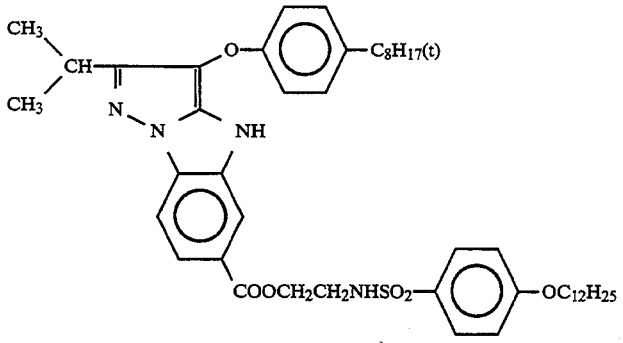

m-15

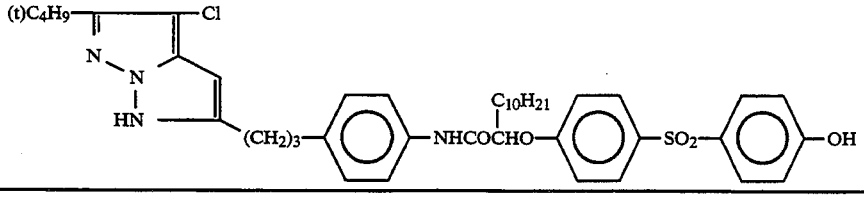

Compounds that release, through coupling, a photographically useful residue can also be used in the present invention. Suitable DIR couplers that release development inhibitors are disclosed in a patent described in *Research Disclosure*, No. 17643, VII-F; JP-A-57-151944, JP-A-57-154234, JP-A-60-184248 and JP-A-63-37346; and U.S. Pat. Nos. 4,248,962 and 4,782,012.

As couplers that release nucleating agents or development accelerators during development, advantageously applicable are those disclosed in U.K. Patent Nos. 2,097,140 and 2,131,188; and JP-A-59-157638 and JP-A-59-170840.

Other compounds that can be used in the photo-sensitive material of the present invention include, but not imited to, a competitive coupler disclosed in U.S. Pat. No. 4,130,427; couplers having multi-equivalence disclosed in U.S. Pat. Nos. 4,283,472, 4,338,393, and 4,310,618; DIR redox compound releasing couplers, DIR coupler releasing couplers, DIR coupler releasing redox compounds or DIR redox releasing redox compounds disclosed in JP-A-60-185950 and JP-A-62-24252; a coupler disclosed in European Patent No. 173302A that is adapted to release dyes having leuco dye reciprocity characteristics after being eliminated from the coupler; bleaching accelerator releasing couplers disclosed in *Research Disclosure*, Nos. 11449 and 24241 as well as in JP-A-61-201247; a ligand releasing coupler disclosed in U.S. Pat. No. 4,553,477; a coupler that releases leuco dyes disclosed in JP-A-63-75747; and a coupler that releases fluorescent dyes disclosed in U.S. Pat. No. 4,774,181.

A standard amount of these color couplers used in this invention ranges from 0.001 to 1 mol per 1 mol of the sensitive silver halide. Preferably, the amounts of yellow, magenta and cyan couplers range from 0.01 to 0.5 mol, from 0.003 to 0.3 mol and from 0.002 to 0.3 mol, respectively.

The compound represented in the general formula (I) may be used with a known anti-fading agent. With the anti-fading agent, anti-fading becomes more effective. In addition, two or more compounds represented in the general formula (I) may be used together.

Representative organic anti-fading agents for cyan, magenta and/or yellow images used together with the present compound include: hydroquinones, 6-hydroxychromans, 5-hydroxymalans, spiro-chromans and p-alkoxyphenols, hindered phenols such as bisphenols; gallic acid derivatives, methylenedioxybenzenes, aminophenols, hindered amines and ether or ester derivatives thereof obtained by means of silylation or alkylation of phenolic hydroxyl groups of these compounds. In addition, metal complexes represented by bis(-salicylaldoximato)nickel complex and (bis-N,N-dialkyldithiocarbamato)nickel complex may also be used.

Examples of such organic anti-fading agents are: hydroquinones disclosed in U.S. Pat. Nos. 2,360,290, 2,418,613, 2,700,453, 2,701,197, 2,728,659, 2,732,300, 2,735,765, 3,982,944 and 4,430,425, U.K. Patent No. 1363921, and U.S. Pat. Nos. 2,710,801 and 2,816,028; 6-hydroxychromans, 5-hydroxychromans and spirochromans disclosed in JP-A-52-152225 and U.S. Pat. Nos. 3,432,300, 3,573,050, 3,574,627, 3,698,909 and 3,764,337; spiroindanes disclosed in U.S. Pat. No. 4,360,589; p-alkoxyphenols disclosed in U.S. Pat. No. 2,735,765, U.K. Patent No. 2066975, JP-A-59-10539 and JP-B-57-19765; hindered phenols disclosed in U.S. Pat. Nos. 3,700,455 and 4,228,235, JP-A-52-72224 and JP-B-52-6623; gallic acid derivatives disclosed in U.S. Pat. No. 3,457,079; methylenedioxybenzenes disclosed in U.S. Pat. No. 4,332,886; aminophenols disclosed in JP-B-56-21144; hindered amines disclosed in U.S. Pat. Nos. 3,336,135 and 4,268,593, U.K. Patent Nos. 1326889, 1354313 and 1410846, JP-B-51-1420, JP-A-58-114036, JP-A-59-53846 and JP-A-59-78344; and metal complexes disclosed in U.S. Pat. Nos. 4,050,938 and 4,241,155 and U.K. Patent No. 2027731(A). These compounds are adapted to achieve the desired objects when 5–100%, by weight, of the compounds with respect to the coupler is co-emulsified with the latter and added to a sensitive layer.

The silver halide photo-sensitive material according to this invention may contain, as the color fog inhibitors, hydroquinone derivatives, aminophenol derivatives and derivatives of gallic and ascorbic acids. To avoid deterioration of a cyan dye image due to heat and especially to light, an ultraviolet light absorbing agent may be incorporated advantageously in a cyan generating layer and two layers adjacent to both sides thereof.

Available ultraviolet light absorbing agents may be: benzotriazole compounds substituted by an aryl group (such as those disclosed in U.S. Pat. No. 3,533,794), 4-thiazolidone compounds (such as those disclosed in U.S. Pat. Nos. 3,314,794 and 3,352,681), benzophenone compounds (such as those disclosed in JP-A-46-2784), cinnamic acid ester compounds (such as those disclosed in U.S. Pat. Nos. 3,705,805 and 3,707,395), butadiene compounds (such as those disclosed in U.S. Pat. No. 4,045,229), benzoxazole compounds (such as those disclosed in U.S. Pat. Nos. 3,406,070 and 4,271,307) or triazine compounds (such as those disclosed in JP-A-46-3335). In addition, couplers having ultraviolet light absorbing characteristic (such as α-naphthol-based cyan dye forming couplers) and polymers having the same characteristic may be used. These ultraviolet light absorbing agents may be mordated in a specific layer or layers. A preferable ultraviolet light absorbing agent is the benzotriazole compounds substituted by an aryl group.

The photo-sensitive material according to this invention contains at least one of the compounds represented by the general formula (I) in at least one layer on the supports therefor.

In color photo-sensitive materials, the support is typically provided with at least one of a blue sensitive silver halide emulsion layer, a green sensitive silver halide emulsion layer and a red sensitive silver halide emulsion layer formed thereon in this order by coating. However, the order of coating may be altered. An infrared sensitive silver halide emulsion layer may be used in place of at least one of the above mentioned sensitive emulsion layers. Color reproduction according to the subtractive color process can be achieved by means of containing in these sensitive emulsion layers the silver halide emulsions sensitive to the respective wavebands and the color couplers adapted to yield dyes having a relation of complementary color to sensitive light. More specifically, a non-diffusion yellow coupler adapted to yield a non-diffusion yellow dye is contained in the blue sensitive silver halide emulsion layer. Likewise, a non-diffusion magenta coupler adapted to yield a non-diffusion magenta dye is contained in the green sensitive silver halide emulsion layer and a non-diffusion cyan coupler adapted to yield a non-diffusion cyan dye is contained in the red sensitive silver halide emulsion layer. It is not necessarily required that there be a correspondence of the color generation hue between the sensitive emulsion layer and the color coupler.

Applications of the compounds used in this invention are, for example, black-and-white film, color paper, color reversal paper, direct positive color photo-sensitive materials, color negative film, color positive film and color reversal film. The compounds can advantageously be applied to color photo-sensitive materials having reflection substrates (such as color paper and the color reversal paper) and color photo-sensitive materials having positive images (such as direct positive color photo-sensitive materials, color positive film and the color reversal film). A particularly suitable application of the compound is color photo-sensitive materials having reflection substrates.

The silver halide used in the present invention may be silver chloride, silver bromide, silver chlorobromide, silver iodochlorobromide, silver iodobromide or silver iodochloride. It is, however, preferable to mainly use a silver iodochlorobromide, silver iodoboromide or silver iodochloride emulsion containing from 1 to 20 mol % of silver iodide for color negative film, color reversal film or color reversal paper which are required to be highly sensitive for photographing. It is preferable to use a silver chlorobromide or pure silver iodide emulsion containing silver iodide ranging from 50 to 100 mol % for direct positive color photo-sensitive materials of an internal latent image type that has not been previously fogged. In addition, for color paper which is to be subjected to rapid processing, it is preferable to use a silver chlorobromide or pure silver chloride emulsion that contains substantially no silver iodide and has the silver chloride contents of from 90 to 100 mol %, preferably from 95 to 100 mol %, and more preferably from 98 to 100 mol %.

To improve the sharpness of the images, the dyes (especially oxonol-based dyes) in which color can be removed through the process disclosed in European Patent Publication No. 0337490 A2, pages 27–76, may be advantageously added to the hydrophilic colloidal layer in the photo-sensitive material according to the present invention such that the optical reflection density of the photo-sensitive material at 680 nm becomes 0.70 or higher. Alternatively, it is preferable that a waterproof resin layer of the support contains at least 12%, by weight, (more preferably at least 14%, by weight) of titanium oxide of which the surface is treated with divalent through quadrivalent alcohols (e.g., trimethylolethane).

In addition, it is preferable to use together with the couplers a color image storability improving compounds such as those disclosed in European Patent No. 0277589A. In particular, such improving compounds may be advantageously used with the above mentioned pyrazoloazole coupler or the pyrroloazole couplers More specifically, it is preferable, for preventing any adverse effects such as staining because of color generating dyes formed as a result of a reaction of the couplers with color developing agents left in the layer or oxidants thereof during storage after processing, to use single or a combination of a compound (F) capable of chemically bonding to the aromatic amine developing agents left after color developing processing, thereby producing substantially colorless and chemically inactive compounds and/or a compound (G) capable of chemically bonding to the oxidants of the aromatic amine developing agents left after color developing processing, thereby producing substantially colorless and chemically inactive compounds.

It is also preferable to add mildewproofing agents as disclosed in JP-A-63-271247 to the photo-sensitive material according to this invention so as to eliminate the problem of mildew, or bacteria growing in the hydrophilic colloidal layer, which otherwise may be a cause of image deterioration.

As the support used for the photo-sensitive material of the present invention, a substrate may be used in which a white polyester support or a layer containing white dyes for displaying is provided on the support at the side having the silver halide emulsion layer. To further improve the sharpness, it is preferable to form by coating an antihalation layer on the side coated with the silver halide emulsion layer or on the back side of the support. The transmission density of the support is preferably within the range from 0.35 to 0.8 to ensure a clear view on the display regardless of whether the light is a transmission light or a reflecting light.

The photo-sensitive material according to this invention is subjected to image exposure and color development, and is thereafter processed with a processing solution having a bleaching capacity (a bleaching bath and a bleach-fixing bath). Details of the process are disclosed in Research Disclosure, No. 17643, pages 28–29 and No. 18716, page 615, from the left column to the right. For example, the process involves a color development process, a bleaching process, a fixing process and a washing process. The bleach-fixing process using the bleach-fixing solution may be performed rather than the bleaching process with the bleaching solution and the fixing process with a fixer. Alternatively, the bleaching, fixing and bleach-fixing processes may be combined in any order. A stabilizing process may be performed instead of or after the washing process. In addition, a prehardening process, a neutralization process for the prehardened layer, a stopfixing process, an afterhardening process, an adjusting process, an intensifying process or the like may be performed in combination with the above mentioned processes. To form color reversal images, the photo-sensitive material is subjected to a first development after the image is exposured and is then subjected to a reversing process, following which the color development process and the subsequent processes are performed. In this event, the adjusting process is commonly performed between the color development process and the bleaching process. An itermediate washing process may be provided, if necessary, between the above mentioned processes.

Those disclosed in the published Japanese patent applications as set forth in Table 1 through Table 5 below and the European Patent Publication No. 0519190 A2 are preferable examples of the silver halide emulsion, other materials (additives), photograph forming layers (layer structure or the like), and the methods and the processing additives applied to process the photo-sensitive material. In particular, those disclosed in European Patent Publication No. 0355660 A2 is advantageously used.

TABLE 1

| PHOTOGRAPH COMPONENTS | JP-A-62-215272 | JP-A-2-33144 | EP 355660 A2 |
|---|---|---|---|
| Silver Halide Emulsion | p.10, l.6 of URC to p.12, l.5 of LLC; and p.12, 4th line from bottom of LRC to p.13 l.17 of ULC | p.28, l.16 of URC to p.29, l.11 of LRC; and p.30, ll.2–5 | p.45, l.53 to p.47 l.3; and p.47, ll.20–22 |
| Silver Halide Solvent | p.12, ll.6–14 of LLC and p.13, 3rd line from bottom of ULC to p.18, last line of LLC | — | — |
| Chemical Sensitizer | p.12, 3rd line from bottom of LLC to 5th line from bottom of LRC; and p.18, l.1 of LRC to p.22, 9th line from bottom of URC | p.29, ll.12 to last line of LRC | p.47, ll.4–9 |
| Spectral Sensitizer | p.22, 8th line from bottom of | p.30, ll.1–13 of ULC | p.47, ll.10–15 |

TABLE 1-continued

| PHOTOGRAPH COMPONENTS | JP-A-62-215272 | JP-A-2-33144 | EP 355660 A2 |
|---|---|---|---|
| (Spectral Sensitization) | URC to p.38, last line | | |
| Emulsion Stabilizer | p.39, l.1 of ULC to p.72, last line of URC | p.30, l.14 of ULC to l.1 of URC | p.47, ll.16–19 |
| Development Accelerator | p.72, l.1 of LLC to p.91, l.3 of URC | — | — |

*ULC = upper left column; URC = upper right column; LLC = lower left column; LRC = lower right column

TABLE 2

| PHOTOGRAPH COMPONENTS | JP-A-62-215272 | JP-A-2-33144 | EP 355660 A2 |
|---|---|---|---|
| Color Couplers (Cyan, Magenta, Yellow Couplers) | p.91, l.4 of URC to p.121, l.6 of ULC | p.3, l.14 of URC to p.18, last line of ULC; and p.30, l.6 of URC to p.35, l.11 of LRC | p.4, ll.15–27; p.5, l.30 to p.28, last line; p.45, ll.29–31; and p.47, l.23 to p.63, l.50 |
| Color Generation Accelerator | p.121, l.7 of ULC to p.125, l.1 of URC | — | — |
| Ultraviolet Light Absorbing Agent | p.125, l.2 of URC to p.127, last line of LLC | p.37, l.14 of LRC to p.38, l.11 of ULC | p.65, ll.22–31 |
| Anti-fading Agent (Image Stabilizer) | p.127, l.1 of LRC to p.137, l.8 of LLC | p.36, l.12 of URC to p.37, l.19 of ULC | p.4, l.30 to p.5, l.23; p.29, l.1 to p.45, l.25; p.45, ll.33–40; and p.65, ll.2–21 |
| High-boiling and/or Low-boiling Organic Solvent | p.137, l.9 of LLC to p.144, last line of URC | p.35, l.14 of LRC to p.36, 4th line from bottom of ULC | p.64, ll.1–51 |
| Dispersion Methods for Photographing Additives | p.144, l.1 of LLC to p.146, l.7 of URC | p.27, l.10 of LRC to p.28, last line of ULC; and p.35, l.12 of LRC to p.36, l.7 of URC | p.63, l.51 to p.64, l.56 |

TABLE 3

| PHOTOGRAPH COMPONENTS | JP-A-62-215272 | JP-A-2-33144 | EP 355660 A2 |
|---|---|---|---|
| Hardening Agent | p.146, l.8 of URC to p.155, l.4 of LLC | — | — |
| Developing Agent Precursor | p.155, l.5 of LLC to p.155, l.2 of LRc | — | — |
| Development Inhibitor Releasing Compound | p.155, ll.3–9 of LRC | — | — |
| Support | p.155, l.19 of LRC to p.156, l.14 of ULC | p.38, l.18 of URC to p.39, l.3 of ULC | p.66, l.29 to p.67, l.13 |
| Photosensitive material Layer Structure | p.156, l.15 of ULC to p.156, l.14 of LRC | p.28, ll.1–15 of URC | p.45, ll.41–52 |

TABLE 3-continued

| PHOTOGRAPH COMPONENTS | JP-A-62-215272 | JP-A-2-33144 | EP 355660 A2 |
|---|---|---|---|
| Dye | p.156, l.15 of LRC to p.184, last line of LRC | p.38, l.12 of ULC to l.7 of URC | p.66, ll.18–22 |
| Color Mixing Inhibitor | p.185, l.1 of ULC to p.188, l.3 of LRC | p.36, ll.8–11 of URC | p.64, l.57 to p.65, l.1 |
| Gradation Adjusting Agent | p.188, ll.4–8 of LRC | — | — |

TABLE 4

| PHOTOGRAPH COMPONENTS | JP-A-62-215272 | JP-A-2-33144 | EP 355660 A2 |
|---|---|---|---|
| Stain Inhibitor | p.188, l.9 of LRC to p.193, l.10 of LRC | p.37, last line of ULC to l.13 of LRC | p.65, l.32 to p.66, l.17 |
| Surfactant | p.201, l.1 of LLC to p.210, last line of URC | p.18, l.1 of URC to p.24, last line of LRC; and p.27, 10th line from bottom of LLC to l.9 of LRC | — |
| Fluorine-containing Compound (antistatic agent, coating aid, lubricant, adhesion inhibitor, etc.) | p.210, l.1 of LLC to p.222, l.5 of LLC | p.25, l.1 of ULC to p.27, l.9 of LRC | — |
| Binder (hydrophilic colloid) | p.222, l.6 of LLC to p.225, last line of ULC | p.38, ll.8–18 of URC | p.66, ll.23–28 |
| Thickening Agent | p.225, l.1 of URC to p.227, l.2 of URC | — | — |
| Antistatic Agent | p.227, l.3 of URC to p.230, l.1 of ULC | — | — |

TABLE 5

| PHOTOGRAPH COMPONENTS | JP-A-62-215272 | JP-A-2-33144 | EP 355660 A2 |
|---|---|---|---|
| Polymer Latex | p.230, l.2 of ULC to p.239, last line | — | — |
| Matte Agent | p.240, l.1 of ULC to p.240, last line of URC | — | — |
| Photographic Processing Methods (process and additives) | p.3, l.7 of URC to p.10, l.5 of URC. | p.39, l.4 of ULC to p.42, last line of ULC | p.67, l.14 to p.69, l.28 |

NOTE:
Citations from JP-A-62-215272 includes the amended contents in the Amendment of March 16, 1987 printed at the end of this publication.
Also for the color couplers, it is preferable to use as the yellow coupler a so-called short-wave type yellow coupler disclosed in JP-A-63-231451, JP-A-63-123047, JP-A-63-241547, JP-A-1-173499, JP-A-1-213648 and JP-A-1-250944.

The foregoing features of the present invention will be more readily apparent in the context of a specifically delineated set of examples and a reference. However, it should be understood that the present invention is not limited to those particular examples and the reference as long as it does not depart from the spirit and scope of the appended claims.

EXAMPLE 1

(Manufacture of Sample No. 101)

Both surfaces of a paper support laminated with polyethylene were subjected to corona discharge. Sodium dodecylbenzenesulfonate was then added to gelatin, which was then coated on the surface as a base layer. Various photograph structure layers were coated thereon to make a multilayer color photographic printing paper having the layer structure as set forth below. Coating solutions were prepared in the manner described below.

Preparation of Fifth Layer Coating Solution 33 ml of ethyl acetate was added to dissolve 33 g of a cyan coupler (C-7), 10 g of an ultraviolet light absorbing agent (UV-2), 0.6 g of a color image stabilizer (Cpd-9), 0.6 g of a color image stabilizer (Cpd-10), 0.6 g of a color image stabilizer (Cpd-11), 0.6 g of a color image stabilizer (Cpd-8), 0.6 g of a color image stabilizer (Cpd-6), 18 g of a color image stabilizer (Cpd-1) and 57 ml of a high-boiling organic solvent (Solv-3). The resultant solution was added to 270 ml of a 20%-gelatin aqueous solution containing 7.0 g of sodium dodecylbenzenesulfonate. The solution was then emulsified by using a high-speed stirrer to prepare an emulsified dispersion.

A silver chlorobromide emulsion was also prepared that consists of particles of silver halide dispersed in the dispersion medium. The particles were cubic. The emulsion was a 1:4 mixture (Ag molar ratio) of a large-size emulsion C and a small-size emulsion C. The silver halide dispersed in the large-size and small-size emulsions were 0.50 μm and 0.41 μm, respectively, while fluctuation coeficients of the particle size distribution were 0.09 and 0.11, respectively. In the emulsions, each silver halide particle consists of 0.8 mol % of AgBr localized at a portion of the surfaces of the particles and the remainder is silver chloride. The emulsion was provided with a red-sensitive dye E as set forth in Table 8 below added thereto at the amount of $0.9\times10^{-4}$ mol and $1.1\times10^{-4}$ mol per 1 mol of silver halide for the large-size and the small-size emulsions, respectively. In addition, a compound F as set forth in Table 8 below was also added at the amount of $2.6\times10^{-3}$ mol per 1 mol of silver halide. Chemical aging was performed with additions of sulfur and gold sensitizers. The above mentioned emulsified dispersion and the red-sensitive silver chlorobromide emulsion were mixed and dissolved. Prepared in this way the fifth layer coating solution has the formulation as set forth in Table 11 below.

The method used for preparing the fifth layer coating was also used to prepare the first through the fourth, and the sixth and seventh layers. As the gelatin hardening agent, 1-oxy-3,5-dichloro-s-triazine sodium salt was used.

In addition, Cpd-14 and Cpd-15 were added to each layer in the total amounts of 25.0 mg/m$^2$ and 50.0 mg/m$^2$, respectively.

Spectral sensitizing dyes as set forth in Table 6 through Table 8 below were used as the silver chlorobromide emulsion for the individual sensitive emulsion layers.

TABLE 6

BLUE-SENSITIZING EMULSION LAYER

SENSITIZING DYE A

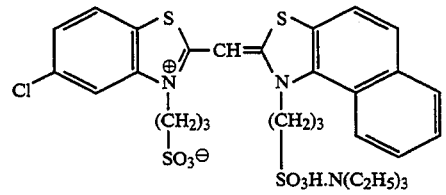

and

SENSITIZING DYE B

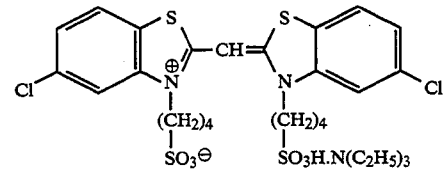

$2.0\times10^{-4}$ mol and $2.5\times10^{-4}$ mole per 1 mol of silver halide for the large-size and the small-size emulsions, respectively.

TABLE 7

GREEN-SENSITIZING EMULSION LAYER

SENSITIZING DYE C

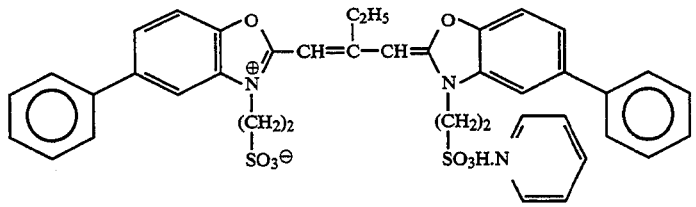

$4.0\times10^{-4}$ mol and $5.6\times10^{-4}$ mol per 1 mol of silver halide for the large-size and the small-size emulsions B, respectively.

SENSITIZING DYE D

TABLE 7-continued

GREEN-SENSITIZING EMULSION LAYER

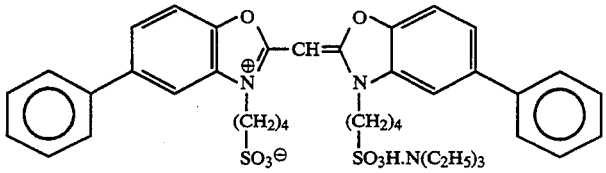

$7.0 \times 10^{-5}$ mol and $1.0 \times 10^{-5}$ mol per 1 mol of silver halide for the large-size and the small-size emulsions B, respectively.

TABLE 8

RED-SENSITIZING EMULSION LAYER

SENSITIZING DYE E

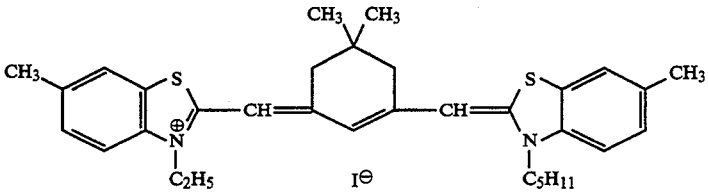

COMPOUND F

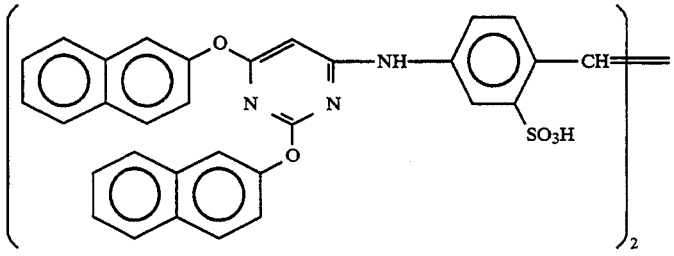

In addition, 1-(5-methylureidophenyl)-5-mercaptotetrazole was added to the blue-, green-, and red-sensitive emulsion layers at $8.5\times10^{-4}$ mol, $7.7\times10^{-4}$ mol and $2.5\times10^{-4}$ mol, respectively, per 1 mol of silver halide.

Further, 4-hydroxy-6-methyl-1,3,3a,7-tetraazaindene was added to the blue- and green-sensitive emulsion layers at $1\times10^{-4}$ mol and $2\times10^{-4}$ mol, respectively, per 1 mol of silver halide.

Besides, dyes as set forth below were added to the emulsion layers to avoid irradiation. (The numerals within parentheses identify the amount of the dyes coated.)

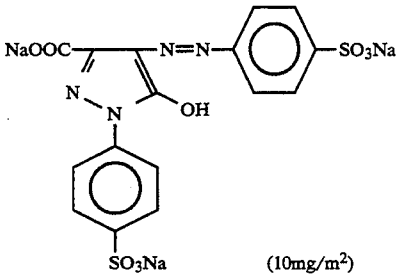

(10mg/m²)

-continued

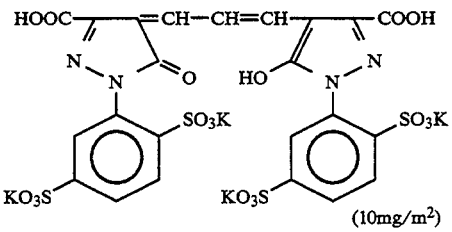

(10mg/m²)

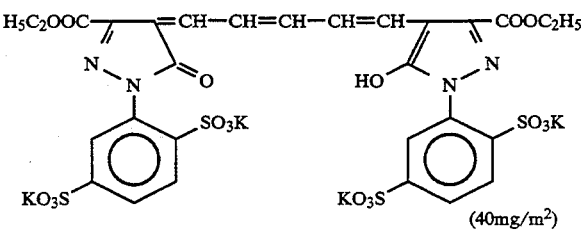

(40mg/m²)

and

-continued

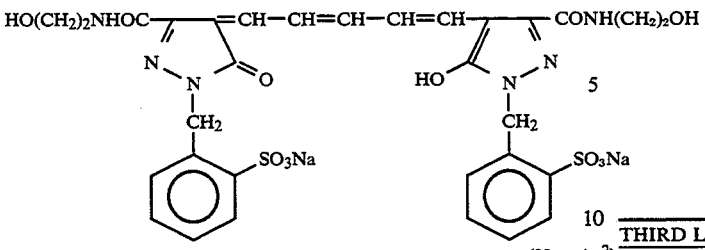

(20mg/m²)

(LAYER STRUCTURE)

Formulations of the individual layers are set forth in Table 9 through Table 11 below. The numerals identify the coating amount (g/m²). The coating amount of the silver chlorobromide emulsion is converted into that of silver.

TABLE 9

| | |
|---|---|
| SUPPORT<br>Paper laminated with polyethylene<br>(A white dye ($TiO_2$) and a blue-tint dye (ultramarine blue) are contained in the polyethylene at the first layer side) | |
| FIRST LAYER (BLUE-SENSITIVE EMULSION LAYER) | |
| Silver Chlorobromide Emulsion (3:7 mixture (silver molar ratio) of a large-size emulsion A and a small-size emulsion A having average particle sizes of 0.88 μm and 0.70 μm, respectively. Fluctuation coefficients of the particle size distribution were 0.08 and 0.10, respectively. In the emulsions, each silver halide particle consists of 0.3 mol % of silver bromide localized at a portion of surfaces of the particles and the remainder, silver chloride. | 0.27 |
| Gelatin | 1.36 |
| Yellow Coupler (ExY-1) | 0.79 |
| Color Image Stabilizer (Cpd-1) | 0.08 |
| Color Image Stabilizer (Cpd-2) | 0.04 |
| Color Image Stabilizer (Cpd-3) | 0.08 |
| Solvent (Solv-1) | 0.13 |
| Solvent (Solv-2) | 0.13 |
| SECOND LAYER (COLOR MIXING INHIBITING LAYER) | |
| Gelatin | 1.00 |
| Color Mixing Inhibitor (Cpd-4) | 0.06 |
| Solvent (Solv-6) | 0.03 |
| Solvent (Solv-2) | 0.25 |
| Solvent (Solv-3) | 0.25 |

TABLE 10

| | |
|---|---|
| THIRD LAYER (GREEN-SENSITIVE EMULSION LAYER) | |
| Silver Chlorobromide Emulsion (1:3 mixture (silver molar ratio) of a large-size emulsion B and a small-size emulsion B having average particle sizes of 0.55 μm and 0.39 μm, respectively. Fluctuation coefficients of the particle size distribution were 0.10 and 0.08, respectively. In the emulsions, each silver halide particle consists of 0.8 mol % of silver bromide localized at a portion of surfaces of the particles and the remainder is silver chloride. | 0.13 |
| Gelatin | 1.45 |
| Magenta Coupler (M-1) | 0.16 |
| Color Image Stabilizer (Cpd-5) | 0.05 |
| Color Image Stabilizer (Cpd-2) | 0.03 |
| Color Image Stabilizer (Cpd-6) | 0.01 |
| Color Image Stabilizer (Cpd-7) | 0.01 |
| Color Image Stabilizer (Cpd-8) | 0.08 |
| Solvent (Solv-3) | 0.50 |
| Solvent (Solv-4) | 0.15 |
| Solvent (Solv-5) | 0.15 |
| FOURTH LAYER (COLOR MIXING INHIBITING LAYER) | |
| Gelatin | 0.70 |
| Color Mixing Inhibitor (Cpd-4) | 0.04 |
| Solvent (Solv-7) | 0.02 |
| Solvent (Solv-2) | 0.18 |
| Solvent (Solv-3) | 0.18 |

TABLE 11

| | |
|---|---|
| FIFTH LAYER (RED-SENSITIVE EMULSION LAYER) | |
| Silver Chlorobromide | 0.09 |
| Gelatin | 0.85 |
| Cyan Coupler (C-7) | 0.33 |
| Ultraviolet Light Absorbing Agent (UV-2) | 0.10 |
| Color Image Stabilizer (Cpd-1) | 0.18 |
| Color Image Stabilizer (Cpd-6) | 0.006 |
| Color Image Stabilizer (Cpd-8) | 0.006 |
| Color Image Stabilizer (Cpd-9) | 0.006 |
| Color Image Stabilizer (Cpd-10) | 0.006 |
| Color Image Stabilizer (Cpd-11) | 0.006 |
| Solvent (Solv-3) | 0.66 |
| SIXTH LAYER (ULTRAVIOLET LIGHT ABSORBING LAYER) | |
| Gelatin | 0.85 |
| Ultraviolet Light Absorbing Agent (UV-1) | 0.65 |
| Color Image Stabilizer (Cpd-12) | 0.15 |
| Color Image Stabilizer (Cpd-5) | 0.02 |
| SEVENTH LAYER (PROTECTIVE LAYER) | |
| Gelatin | 1.13 |
| Copolymer of Polyvinyl alcohol denatured with acryl (denaturation rate; 17%) | 0.05 |
| Liquid Paraffin | 0.02 |
| Color Image Stabilizer (Cpd-13) | 0.01 |

(ExY) YELLOW COUPLER

1:1:1 MIXTURE (MOLAR RATIO) OF:

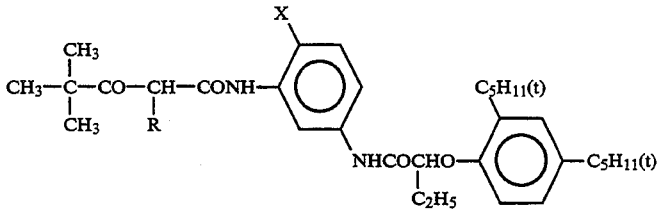

R = 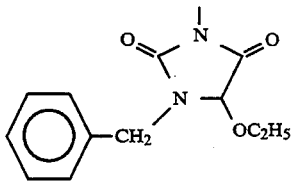 X = Cl and R = 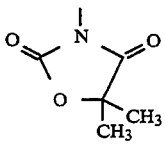 X = $OCH_3$ and

-continued
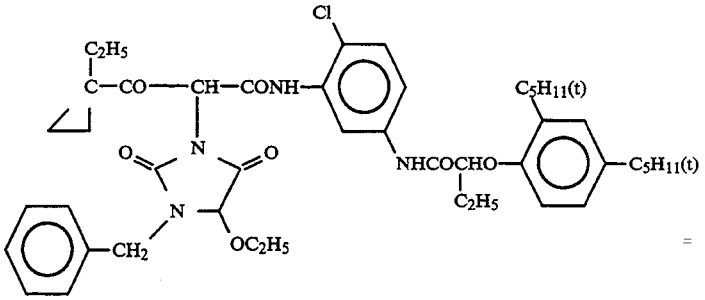
(Cpd-1) COLOR IMAGE STABILIZER
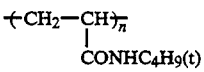
AVERAGE MOLECULAR WEIGHT 60,000
(Cpd-2) COLOR IMAGE STABILIZER
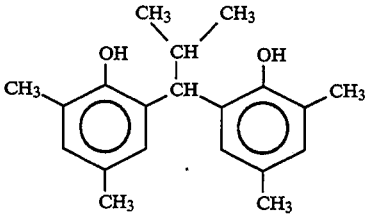
(Cpd-3) COLOR IMAGE STABILIZER
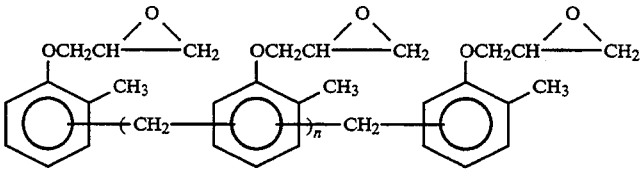
n = 7–8 (AVERAGE)
(Cpd-4) COLOR MIXING INHIBITOR
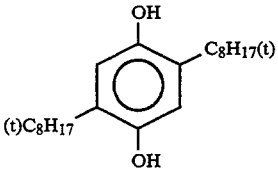
(Cpd-5) COLOR IMAGE STABILIZER
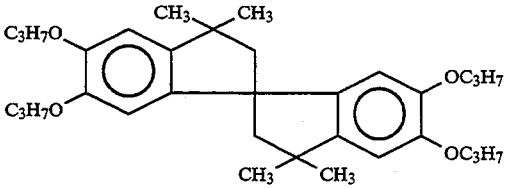
(Cpd-6) COLOR IMAGE STABILIZER
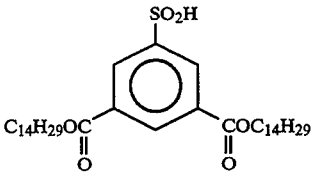
(Cpd-7) COLOR IMAGE STABILIZER
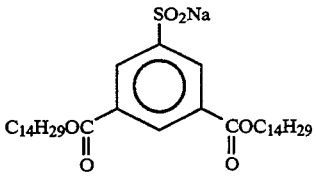
(Cpd-8) COLOR IMAGE STABILIZER
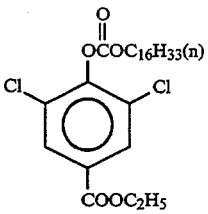
(Cpd-9) COLOR IMAGE STABILIZER
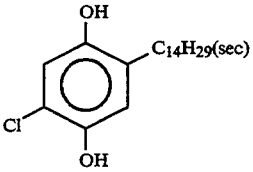
(Cpd-10) COLOR IMAGE STABILIZER
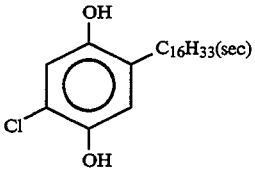
(Cpd-11) COLOR IMAGE STABILIZER
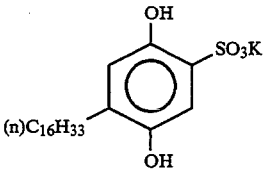

(Cpd-12) COLOR IMAGE STABILIZER

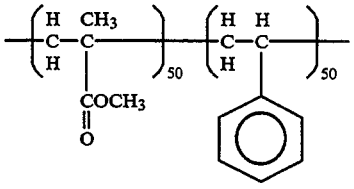

AVERAGE MOLECULAR WEIGHT 60,000

-continued (Cpd-13) COLOR IMAGE STABILIZER

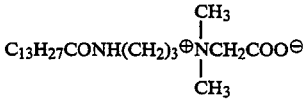

(Cpd-14) ANTISEPTIC

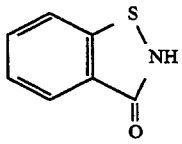

(Cpd-15) ANTISEPTIC

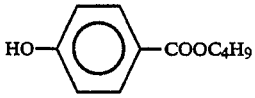

(Solv-1) SOLVENT

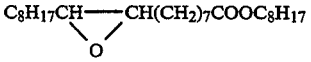

(Solv-2) SOLVENT

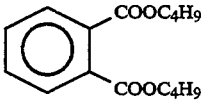

(Solv-3) SOLVENT

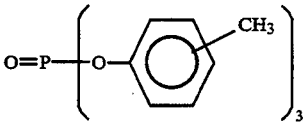

(Solv-4) SOLVENT

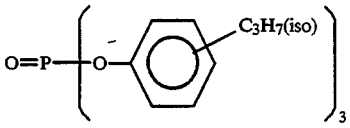

(Solv-5) SOLVENT

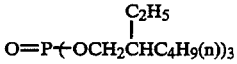

(Solv-6) SOLVENT

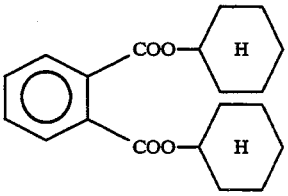

(Solv-7) SOLVENT

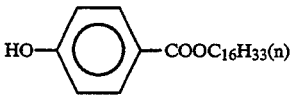

(UV-1) ULTRAVIOLET LIGHT ABSORBING AGENT
1:5:10:5 MIXTURE (WEIGHT RATIO) OF (1), (2), (3), AND (4)

(1)

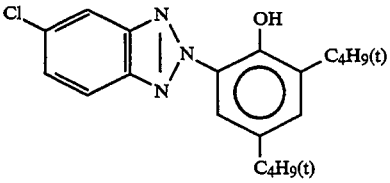

(2)

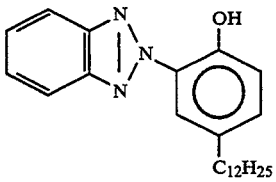

(3)

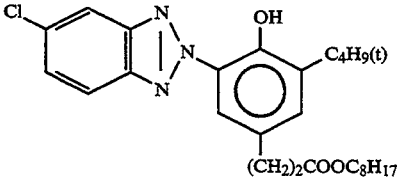

(4)

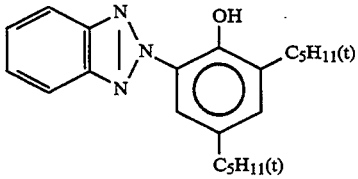

(UV-2) ULTRAVIOLET LIGHT ABSORBING AGENT
1:2:2 MIXTURE (WEIGHT RATIO) OF (1), (2), AND (3)

(1)

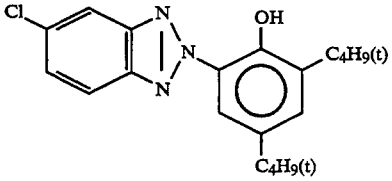

(2)

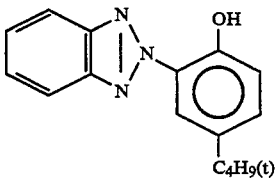

(3)

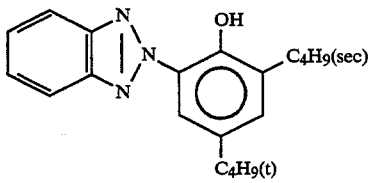

Manufacture of Samples 102–121)

In preparation of the emulsified dispersion for the fifth layer coating solution, couplers and high-boiling organic solvents as set forth in Table 12 below were used in place of the coupler and the high-boiling organic solvent, respectively, used in Sample 101. In addition, the high-boiling organic solvent volume was doubled for Sample 102. Additives as set forth in Table 12 were added to Samples 103–112, 114, 115, 117, 118, 120 and 121 at the same amount as the high-boiling organic solvent. Coating solutions were prepared in the same manner as those used for the Sample 101 to make Samples 102 through 121.

In this event, the couplers used were equimolecular in amount to C-7 in Sample 101.

CS-1, CS-2 and CS-3 were also used as comparative compounds.

COMPARATIVE ADDITIVES

CS-1

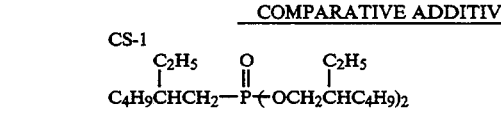

COMPOUND (I-1) DISCLOSED IN JP-A-63-301941

CS-2

$(C_8H_{17})_3P{=}O$

COMPOUND (I-13) DISCLOSED IN JP-A-63-301941

CS-3

$(C_6H_{13})_3P{=}O$

COMPOUND (I-3) DISCLOSED IN JP-A-63-301941

Each sample was subjected to a gradation exposure with a red filter for sensitometry by using a sensitometer (FWH-type manufactured by Fuji Photo Film Co., Ltd.; color temperature of a light source: 3200K). The exposure was exposed for 0.1 milliseconds at 250 CMS.

Utilizing a test paper processor and processes and processing solutions (having formulations as set forth below) the sample, after exposure was continuously subjected to processing (running development test) until the amount of replenisher came to twice as much as the capacity of a replenisher tank used for the color development.

| Process | Temp. | Time | Replenisher* | Tank Capacity |
|---|---|---|---|---|
| Color Development | 35° C. | 45 sec. | 161 ml | 1 liter |
| Bleach-fix | 35° C. | 45 sec. | 215 ml | 1 liter |
| Stabilization (1) | 35° C. | 20 sec. | — | 0.6 liters |
| Stabilization (2) | 35° C. | 20 sec. | — | 0.6 liters |
| Stabilization (3) | 35° C. | 20 sec. | — | 0.6 liters |
| Stabilization (4) | 35° C. | 20 sec. | 248 ml | 0.6 liters |
| Drying | 80° C. | 60 sec. | | |

*Replenishment rate: per square meter of the photo-sensitive material
*Stabilization steps; 4-tank countercurrent system from (4) to (1)

Formulation of the processing solutions are as follows:

| [Color Developer] | Tank Solution | Replenisher |
|---|---|---|
| Water | 800 ml | 800 ml |
| 1-hydroxyethylidene- | 0.8 ml | 0.8 ml |

-continued

| [Color Developer] | Tank Solution | Replenisher |
|---|---|---|
| 1,1-diphosphonic acid (60%) | | |
| Lithium Sulfate (anhydride) | 2.7 g | — |
| Triethanolamine | 8.0 g | 8.0 g |
| Sodium Chloride | 1.4 g | |
| Potassium bromide | 0.03 g | 0.025 g |
| Diethylhydroxyamine | 4.6 g | 7.2 g |
| Potassium Carbonate | 27 g | 27 g |
| Sodium Sulfite | 0.1 g | 0.2 g |
| N-ethyl-N-(β-methanesulfonamideethyl)-3-methyl-4-aminoaniline. 3/2 sulfuric acid. 1 water salt | 4.5 g | 7.3 g |
| Fluorescent Whitening Agent (4,4'-diaminostilbene based) | 2.0 g | 3.0 g |
| Total (with added water) | 1000 ml | 1000 ml |
| pH (potassium hydroxide added) | 10.25 | 10.80 |

| [Bleach-fixing Solution] (tank solution and replenisher are same) | |
|---|---|
| Water | 400 ml |
| Ammonium Thiosulfate | 100 ml |
| Sodium Sulfite | 17 g |
| Ethylenediaminetetraacetato ferrate (III) Armnonium | 55 g |
| Ferrous disodium ethylenediamine tetraacetate | 5 g |
| Glacial Acetic Acid | 9 g |
| Total (with added water) | 1000 ml |
| pH (25° C.) | 5.40 |
| [Stabilizer] (tank solution and replenisher are same) | |
| Benzisothiazolin-3-one | 0.02 g |
| Polyvinylpyrrolidone | 0.05 g |
| Total (with added water) | 1000 ml |
| pH (25° C.) | 7.40 |

(Evaluation of Samples)

An absorbance spectrum of each sample after processing was measured by using a spectrophotometer (UV365, available from Shimadzu Corporation). More specifically, the absorbance spectrum was obtained for the portions of the sample where the absorbance was equal to 1.0 at the maximum absorption wavelength. The absorbance of the sample corresponding to the spectrum at 600 nm, D600nm, was used as a reference to determine the degree of association. The smaller the value of D600nm indicates a smaller association.

In addition, the maximum color density (Dmax) of each sample after processing was also measured by using a red light.

Further, each sample was subjected to a fading-test for three weeks under the conditions of the temperature being 90° C. and the humidity being 60%. The fading rate (%) of the cyan dye relative to an initial density of 1.0 was measured. The fading rate is a ratio of the faded density to the initial density. The smaller the fading rate is, the less the dye is faded.

Values of D600 nm, Dmax and the fading rate of the samples are set forth in Table 12 below.

TABLE 12

| Sample | Coupler | High-boiling Organic Solvent | Additive | D600nm | Dmax | Fading Rate (%) | Remark |
|---|---|---|---|---|---|---|---|
| 101 | C-7 | Solv-3 | — | 88.8 | 2.23 | 24.1 | Comp. |
| 102* | " | " | — | 81.3 | 2.31 | 23.8 | " |
| 103 | " | " | CS-1 | 88.9 | 2.16 | 25.4 | " |
| 104 | " | " | CS-2 | 63.8 | 2.13 | 45.4 | " |
| 105 | " | " | CS-3 | 63.5 | 2.14 | 45.5 | " |
| 106 | " | " | S-1 | 63.4 | 2.32 | 25.4 | Inv. |
| 107 | " | " | S-3 | 63.3 | 2.30 | 25.6 | " |

TABLE 12-continued

| Sample | Coupler | High-boiling Organic Solvent | Additive | D600nm | Dmax | Fading Rate (%) | Remark |
|---|---|---|---|---|---|---|---|
| 108 | " | " | S-4 | 64.7 | 2.33 | 25.2 | " |
| 109 | " | " | S-7 | 68.5 | 2.26 | 24.8 | " |
| 110 | " | " | S-12 | 63.5 | 2.33 | 25.2 | " |
| 111 | " | " | S-20 | 65.1 | 2.31 | 25.4 | " |
| 112 | " | " | S-27 | 64.9 | 2.30 | 24.9 | " |
| 113 | " | Solv-2 | — | 98.6 | 2.15 | 25.2 | Comp. |
| 114 | " | " | S-1 | 68.4 | 2.22 | 25.4 | Inv. |
| 115 | " | " | S-20 | 69.9 | 2.23 | 24.9 | " |
| 116 | C-8 | Solv-3 | — | 79.4 | 2.28 | 23.9 | Comp. |
| 117 | " | " | S-1 | 63.3 | 2.34 | 24.1 | Inv. |
| 118 | " | " | S-20 | 64.2 | 2.35 | 24.0 | " |
| 119 | C-21 | " | — | 81.5 | 2.34 | 24.3 | Comp. |
| 120 | " | " | S-1 | 63.3 | 2.36 | 24.5 | Inv. |
| 121 | " | " | S-20 | 64.4 | 2.35 | 24.6 | " |

*Volume of the high-boiling organic solvent was doubled for the Sample 102
Comp.: Comparative Example
Inv.: Invention Table 12 indicates the following.

Samples 106 through 112 and the like to which cyclic phosphineoxide and cyclic phosphinate compounds according to this invention were added have the smaller value of D600 nm relative to Sample 101 of the high-boiling organic solvent only and to Sample 103 in which a phosphorous compound CS-1 is not part of the present invention. This means that the association is effectively restricted in the Samples 106 through 112. In addition, these samples exhibit the higher color density with the larger value of Dmax and does not deteriorate the fastness of heat and moisture.

Samples 104 and 105 in which phosphoneoxide CS-2 or CS-3 are not a part of the present invention was added, have smail values of D600 nm, indicating that the association can he restricted. However, the value of Dmax of these samples are smaller and the fading rates thereof are higher, which clearly contrasts the present invention.

EXAMPLE 2

(Manufacture of Samples No. 201–212)

Sample 201 is as same as Sample 101.

Preparation of the emulsified dispersion for the third layer coating solution of Sample 101 was repeated except that the high-boiling organic solvent volume was halved for Sample 202 while additives as set forth in Table 13 were added to the Samples 203 through 212 at an equivalent amount by weight to the high-boiling organic solvents used. The coating solutions thus obtained was applied to paper samples in the manner described above.

Each of the Samples 201 through 212 was subjected to a gradation exposure having a green filter for sensitometry by using the same sensitometer as the one used in the Example 1. The exposure was performed at 250 CMS during an exposure time of 0.1 milliseconds.

The samples after being exposed were subjected to the same development processing as in Sample 101.

(Evaluation of Samples)

After processing, the absorbance spectrum of each sample was measured by using a spectrophotometer (UV365, vailable from Shimadzu Corporation). The absorbance spectrum was obtained for the portions of the sample where the absorbance was equal to 1.0 at the maximum absorption wavelength. The absorbance of the sample corresponding to the spectrum at 500 nm, D500 nm, was used as a reference to determine the degree of association. The smaller the value of D500 nm indicates a smaller association.

In addition, after processing the maximum color density (Dmax) of each sample was also measured by using a green light.

Further, each sample was subjected to a fading-test for three weeks under the conditions of the temperature being 90° C. and the humidity being 60%. The fading rate (%) of the magenta dye relative to an initial density of 1.0 was measured. The fading rate is a ratio of the faded density to the initial density. The smaller the fading rate is, the less the dye is faded.

Values of D500 nm, Dmax and the fading rate of the samples are set forth in Table 13 below. The comparative compounds are the same as those indicated in the Example 1.

TABLE 13

| Sample | Additive | D500nm | Dmax | Fading Rate (%) | Remark |
|---|---|---|---|---|---|
| 201 | — | 81.3 | 2.31 | 14.8 | Comp. |
| 202* | — | 92.5 | 2.26 | 15.6 | " |
| 203 | CS-1 | 91.8 | 2.16 | 15.8 | " |
| 204 | CS-2 | 69.8 | 2.12 | 37.8 | " |
| 205 | CS-3 | 69.5 | 2.13 | 38.6 | " |
| 206 | S-1 | 69.2 | 2.35 | 14.9 | Inv. |
| 207 | S-3 | 69.1 | 2.32 | 15.1 | " |
| 208 | S-4 | 70.0 | 2.34 | 14.8 | " |
| 209 | S-7 | 71.9 | 2.30 | 14.4 | " |
| 210 | S-12 | 69.4 | 2.35 | 15.4 | " |
| 211 | S-20 | 70.1 | 2.34 | 15.3 | " |
| 212 | S-27 | 69.9 | 2.33 | 14.9 | " |

*Volume of the high-boiling organic solvent was halved for the Sample 202
Comp.: Comparative Example
Inv.: Invention Table 13 indicates the following.

Samples 206 through 212 to which cyclic phosphineoxide and cyclic phosphinate compounds according to this invention were added have the smaller value of D500 nm relative to Sample 201 of the high-boiling organic solvent only and to Sample 203 in which a phosphorous compound CS-1 is not part of the present invention. This means that the association is effectively restricted in Samples 206 through 212. In addition, these samples exhibit the higher color density with the larger value of Dmax and does not deteriorate the fastness of heat and moisture.

Samples 204 and 205 in which phosphoneoxide CS-2 or CS-3 are not part of the present invention was added have small values of D500 nm, indicating that the association can be restricted. However, the value of Dmax of these samples are smaller and the fading rates thereof is higher, which clearly contrasts the present invention.

EXAMPLE 3

The compound S-1 (0.1 g) according to the present invention was used in place of a high-boiling organic solvent "oil-1" (dibutyl phthalate) for the ninth layer of a multilayer color reversal photo-sensitive material sample 401 disclosed in Example 4 of U.S. Pat. No. 5,270,148, the disclosure of which is incorporated herein by reference. 0.05 g of the compound S-1 of this invention was added to the tenth layer. The eleventh layer was prepared with the compound S-1 (0.08 g) of this invention rather than the high-boiling organic solvent "oil-1" (dibutyl phthalate). The remaining procedures for making a sample was similar to those disclosed in the publication. The so formed sample 301 was silt into strips of 35 mm in width. The strips were subjected to perforation processing in the same format as commercially available films. The strips were then exposed and processed using suspension-type automatic developer at process No. 11 in Example 14 of U.S. Pat. No. 5,270,148. As a result, excellent color generation and fastness of heat and moisture were exhibited as well as a fine hue.

The silver halide photo-sensitive material according to the present invention has the excellent effects that photographic additives have been solved well and dispersed stably.

In addition, the silver halide photo-sensitive material of this invention shows the excellent effects in which the dye-forming non-diffusion couplers exhibit high color forming properties and the dyes have superior color reproduction without causing fading of the formed images as well as the effect of providing excellent solubility and dispersion stability of various photographic additives.

What is claimed is:

1. A silver halide photo-sensitive material comprising a support having thereon photographic structural layers comprising at least one silver halide emulsion layer, wherein at least one of said photographic structural layers contains at least one compound represented by the following general formula (I):

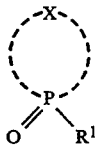

(I)

wherein $R^1$ represents an aliphatic group, an aryl group, an aliphatic oxy group or an aryloxy group, provided that $R^1$ does not bond to a carbon atom in the ring of X; and X represents an alkylene or alkenylene group forming a five- or six-membered ring.

2. A silver halide photo-sensitive material as claimed in claim 1, wherein $R^1$ represents an aryl group, aliphatic oxy group or an aryloxy group.

3. A silver halide photo-sensitive material as claimed in claim 1, wherein $R^1$ represents an aryl group.

4. A silver halide photo-sensitive material as claimed in claim 1, wherein the compound of formula (I) is a compound selected from the group consisting of compounds represented by general formulae (IV) through (VII):

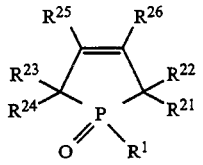

(IV)

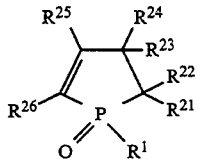

(V)

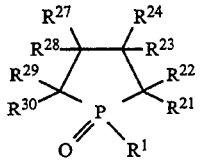

(VI)

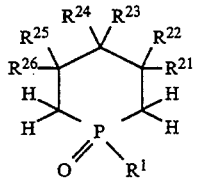

(VII)

wherein $R^1$ is the same meaning as in formula (I), and each of $R^{21}$ through $R^{30}$ represents, independently, a hydrogen atom, an aliphatic group, an aryl group, an aliphatic oxy group, and an aryloxy group, an aliphatic or aryl acyloxy group, an alkoxycarbonyl group, an aryloxycarbonyl group, an aliphatic or aryl sulfonyloxy group, a halogen atom, a cyano group, or a nitro group.

5. A silver halide photo-sensitive material as claimed in claim 4, wherein $R^1$ represents an aryl group, each of $R^{21}$ through $R^{30}$ represents, independently, hydrogen atoms, an aliphatic group or an aliphatic oxy group.

6. A silver halide photo-sensitive material as claimed in claim 4, wherein the compound of formula (I) is present in the range from 0.0002 to 20 g per/$m^2$ of the material.

7. The silver halide photo-sensitive material as claimed in claim 4, wherein $R^{21}$ through $R^{30}$ is a hydrogen atom, an aliphatic group having 1 to 30 carbon atoms, an aryl group having 6 to 30 carbon atoms, an aliphatic oxy group having 1 to 30 carbon atoms, an aryloxy group having 6 to 30 carbon atoms, an aliphatic or aryl acyloxy group having 2 to 30 carbon atoms, an alkoxycarbonyl group having 2 to 30 carbon atoms, an aryloxycarbonyl group having 7 to 30 carbon atoms, or an aliphatic or aryl sulfonyloxy group having 1 to 30 carbon atoms.

8. The silver halide photo-sensitive material as claimed in claim 4, wherein a compound of formula (I) is a compound of formula (IV through (VI).

9. A silver halide photo-sensitive material as claimed in claim 1, wherein X represents an alkylene or alkenylene group forming a five membered ring.

10. A silver halide photo-sensitive material as claimed in claim 1, wherein the photographic structural layer containing the compound of formula (I) is a hydrophilic colloidal layer.

11. A silver halide photo-sensitive material as claimed in claim 10, wherein the hydrophilic colloidal layer is a silver halide emulsion layer containing at least one dye-forming non-diffusion coupler.

12. A silver halide photo-sensitive material as claimed in claim 1, wherein the layer containing at least one of the compounds having a following general formula (I) contain at least one of cyan couplers having the general formula (II) or at least one of magenta couplers having the general formula (III):

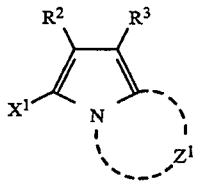

(II)

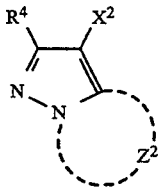

(III)

wherein, each of $Z^1$ and $Z^2$ represents a group of non-metallic atoms required for forming an azole ring in which the hetero atom is nitrogen, each of $R^2$ and $R^3$ represents an electron withdrawing group of which substituent constant $\sigma_p$ in the Hammett equation is not smaller than 0.30, $R^4$ represents a hydrogen atom or a-substituent, each of $X^1$ and $X^2$ represents a hydrogen atom or a group eliminated from the coupler when being subjected to coupling with an oxidation product of an aromatic primary amine color developing agent.

13. A silver halide photo-sensitive material as claimed in claim 12, wherein the azole rings formed together with $Z^1$ and $Z^2$ in the formulae (II) and (III) are represented by:

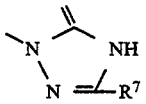

wherein $R^7$ represents a hydrogen atom or a substituent.

14. A silver halide photo-sensitive material as claimed in claim 12, wherein $R^2$ represents a cyano group, $R^3$ represents $—CO_2—R^9$, $R^9$ represents an aliphatic group or an aryl group, and each of $X^1$ and $X^2$ represents a halogen atom or an arylthio group.

15. A silver halide photo-sensitive material as claimed in claim 12, wherein said coupler is present in the range from 0.001 to 1 mol per 1 mol of silver halide.

16. The silver halide photo-sensitive material as claimed in claim 1, wherein $R^1$ contains 6 to 25 carbon atoms.

17. The silver halide photo-sensitive material as claimed in claim 1, wherein $R^1$ is methyl, isopropyl, butyl, t-butyl, cyclohexyl, benzyl, allyl, 2-butoxyethyl, 2-ethylhexyl, octyl, 3,5,5,-trimethylhexyl, dodecyl, phenyl, 2-naphthyl, 3-methylphenyl, 4-methoxyphenyl, 2-chlorophenyl, 4-dodecylpheny, methoxy, 2-ethylhexyloxy, cyclohexyloxy, benzyloxy, t-butoxy, octyloxy, 3,5,5-trimethylhexyloxy. phenoxy, 1-naphthoxy, 4-methoxy-3-methylphenoxy, or 4-dodecylphenoxy.

18. The silver halide photo-sensitive material as claimed in claim 1, wherein $R^1$ is an phenyl group.

* * * * *